US006302533B1

(12) United States Patent
Shimomura et al.

(10) Patent No.: US 6,302,533 B1
(45) Date of Patent: Oct. 16, 2001

(54) ADSORBENT FOR INK JET USE, AN INK RETAINING CONTAINER, AN ADSORPTION MEMBER USING SUCH ADSORBENT, AN INK SUPPLY SYSTEM HAVING SUCH ADSORPTION MEMBER, AND AN INK JET RECORDING APPARATUS

(75) Inventors: Masako Shimomura, Yokohama; Kazuaki Masuda, Kawasaki; Osamu Sato, Chigasaki; Hiromichi Noguchi, Hachioji, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/204,265

(22) Filed: Dec. 3, 1998

(30) Foreign Application Priority Data

Dec. 9, 1997 (JP) ..... 9-339025
Nov. 20, 1998 (JP) ..... 10-331578

(51) Int. Cl.[7] ..... B41J 2/175
(52) U.S. Cl. ..... 347/86; 347/93
(58) Field of Search ..... 347/84, 85, 86, 347/87, 92, 93

(56) References Cited

U.S. PATENT DOCUMENTS

| | | | | |
|---|---|---|---|---|
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,558,333 | | 12/1985 | Sugitani et al. . | |
| 4,680,040 | * | 7/1987 | Gooray et al. | 55/387 |
| 4,723,129 | | 2/1988 | Endo et al. . | |
| 4,740,796 | | 4/1988 | Endo et al. . | |
| 5,467,117 | | 11/1995 | Evans et al. | 347/87 |
| 5,652,610 | | 7/1997 | Kawai et al. | 347/87 |
| 5,922,105 | * | 7/1999 | Fujii et al. | 95/63 |
| 6,165,519 | * | 12/2000 | Lehrer et al. | 426/77 |

FOREIGN PATENT DOCUMENTS

| | | |
|---|---|---|
| 771662 | 5/1997 | (EP) . |
| 791466 | 8/1997 | (EP) . |
| 54-56847 | 5/1979 | (JP) . |
| 58-55331 | 4/1983 | (JP) . |
| 59-123670 | 7/1984 | (JP) . |
| 59-138461 | 8/1984 | (JP) . |
| 60-71260 | 4/1985 | (JP) . |
| 62-60653 | 3/1987 | (JP) . |
| 64-26452 | 1/1989 | (JP) . |
| 2-36199 | 2/1990 | (JP) . |
| 4-348947 | 12/1992 | (JP) . |

* cited by examiner

*Primary Examiner*—Judy Nguyen
(74) *Attorney, Agent, or Firm*—Fitzpatrick, Cella, Harper & Scinto

(57) ABSTRACT

An adsorbent for ink jet use arranged in a position to be in contact with ink, having the higher capability of adsorption with respect to hydrophobic substance contained in ink than colorant therein. Then, an ink retaining container comprises an ink retaining portion for retaining ink to be supplied to an ink jet head, an ink supply opening which becomes the ink supply portion from the ink retaining portion to the head, an atmospheric communication opening for communicating the ink retaining portion with the air outside. This ink retaining container is provided with the above-mentioned adsorption member arranged in a position to be in contact with ink in it. With the adsorbent and the ink retaining container thus arranged, it is made possible to perform ink jet recording with excellent print characteristics by effectively removing the hydrophobic substance eluted form the ink absorbent in the ink retaining container.

33 Claims, 9 Drawing Sheets

ADSORBENT FOR INK JET USE, AN INK RETAINING CONTAINER, AN ADSORPTION MEMBER USING SUCH ADSORBENT, AN INK SUPPLY SYSTEM HAVING SUCH ADSORPTION MEMBER, AND AN INK JET RECORDING APPARATUS

BACKGROUND OF THE INVENTION

1. Field of the Invention

The present invention relates to an adsorption member for ink jet use and an adsorbent used for the adsorption member, as well as to an ink retaining container provided with such member. The invention also relates to an ink supply system and an ink jet recording apparatus, which use such ink retaining container.

2. Related Background Art

In the field of the ink jet technologies, it has been known that liquid droplets are discharged by use of an ink jet head, which is arranged to activate the discharge elements, such as the heat generating elements that produce foaming phenomenon or the eletromechanical converting members that convert electric energy into the solid displacement in the ink (liquid) supply route.

For an ink jet of the kind, there is used exchangeably or integrally the liquid paths that performs ink supply continuously, the liquid chamber that perform the liquid supply efficiently, the supply tubes for use of ink supply to these liquid flow paths and liquid chamber, and the ink tank (ink retaining container) for use of ink supply to the supply tubes and the like.

Then, it is often practiced to provide the ink supply route, particularly the ink retaining container, with the foaming member or the aggregate fibrous member capable of absorbing or holding ink, which is formed from the polymeric resin (including rubber), for generating negative pressure and/or preventing the liquid level from being fluctuated due to the vibration of the carriage. Of course, the ink retaining container and the ink flow route themselves are often molded with polymeric resin.

Now, however, when using the polyurethane foam which is known as an inexpensive foaming member whose foaming is easily controllable, there are some cases where the unreacted substance created in the foaming process or the polyurethane bond which has a weaker bonding force is eluted into ink. If an ink retaining container having such eluted substances in it is used, there is encountered a problem which has been objectively recognized as to exert influence on the ink supply itself at the earlier stage thereof. The typical patents to deal with this condition are such as disclosed in the specifications of Japanese Patent Laid-Open Application Nos. 64-26452 and 04-348947, wherein before the absorbent itself is provided in the ink retaining container, cleaning is conducted in advance so as to remove the eluted substances retained in the ink jet head at the early stage of ink supply. The technique thus invented is effective in that the ink supply capability is brought to the practical level from the very beginning of ink supply to the head.

Also, in the specification of Japanese Patent Laid-Open Application No. 62-60653, it is recognized as a problem that the insoluble substance of the ink retaining container itself is eluted into ink to exert influence on its ink supply performance.

In other words, it is known that the structure, which is needed to supply ink to the ink jet head (ink retaining container main body) itself, is fabricated in the process of manufacture so as not to allow the insoluble substance inherently gained by such structure to exert any influence on ink discharges when this structural member is used for ink supply to the ink jet head.

Nevertheless, in accordance with the researches and studies of the inventors hereof, when the ink retaining container having the absorbent which has been cleaned as described above is exchanged for use repeatedly for a number of times, there are some cases where the ink discharge itself is affected. Then, depending on the cases, it is observed that the images formed by discharged ink droplets themselves present some ink spread or excessive permeability of ink (the phenomenon where ink is permeated thoroughly from the surface to the back side of a recording sheet).

The inventions hereof have assiduously studied to analyze and clarify the causes of the creation of these phenomena. As a result, it has been found that the members which have been formed with the polymeric material, such as the ink retaining container, the absorbent, used for the formation of the ink supply route, are caused to elute the material continuously in such a minute quantity of less than ppm unit that cannot be measured along with the temporal passage. Then, the eluted substance is accumulated gradually in the portion (ink flow paths, for example) which is related to the ink discharges of the head (conceivably, such substance is collectively increased and retained in one specific portion or another), and then, the accumulated substance begins to exert influences on discharges. Further, due to some action, the insoluble substance thus accumulated is allowed to be contained in ink droplets, and discharged together with them.

Particularly, in recent years, the printer that prints the photographic images should perform the highly precise impact of smaller droplets, and the ink discharge performance of such printer is easily affected by the presence of substance slightly eluted from the ink retaining container or by the presence of hydrophobic substance such as the intermediate product of dyestuffs.

Further, there is a tendency in recent years that the droplets of discharged ink themselves are made smaller still in order to perform highly densified recording. Along with this tendency, the discharge openings (ports) are made smaller. Also, the discharge pressure generating unit, such as the electrothermal converting members, is arranged in higher density. As a result, the sectional area of each of the ink supply paths becomes smaller. Likewise, the recording speed is also made faster. To meet such requirement, the discharge speed of liquid ink becomes increasingly faster.

It has also been found that this tendency is easier to take place particularly in condition that the amount of discharge ink droplet is smaller (15 pl or less, for example) or the head is arranged in a higher density (such as the discharge openings (ports) or the flow paths are allowed to deal with 600 dpi or more), and that the pH of ink used is higher, and the recessed portions, stepped portions, or curbed passages are present in the ink supply route. This tendency is also found in a case where either one of the discharge speeds, response frequency, and discharge energy is made higher, or in a case of a head that utilizes the creation of bubbles, while allowing the air outside and bubbles to be communicated with each other.

Further, it has been found that the above phenomenon appears more often when discharges are made after a comparatively long rest subsequent to the discharges having been made once from an ink jet head, and that it appears in the initial stage of discharges after a long rest.

The present invention is designed on the basis of such knowledge that has never been recognized in the conventional art. The invention will be described more specifically as follows:

For example, in the urethan foam which has been produced, there is initially a considerable residue of unreacted substance of such materials as polyol, interfacial active agent, foaming agent, higher alcohol, catalyzer, or the like.

Further, in a case of the foam processed in a specific shape after the thermal press that has been given for a long time at higher temperature, bonding is cut off in this process, and then, free polyol or the like is present in a considerable amount initially. When ink is filled in the absorbent formed by such polyurethane foam, the unreacted substances and the thermally decomposed substance described above are gradually eluted into ink and aggregated, hence being accumulated or lowering the surface tension and pH of ink. As a result, the print quality of characters and images is degraded.

Also, when the container and absorbent are formed by polyolefine fabric, the fabric and the formed product contain the derivative of higher fatty acid, such as calcium stearate, serving as the neutralizer or lubricant. These are eluted into ink (particularly the elution is conspicuous when the absorbent is produced by the application of thermal formation). Here, it has been observed that an elution of the kind does not present any problem in the ink flow paths, but it tends to disturb the ink discharge characteristics when eluted substance adheres to the circumference of the discharge openings (ports).

Hereunder, the examples of phenomena will be simply enumerated as observed in recording performed by use of a head of the kind as follows:

For example, with the discharge amount of 15 pl, there is not greater influence on the twisted prints, but spreading of ink takes place, resulting in the blurred print quality in some cases. With the discharge amount of 10 pl or less, for example, the greatly twisted prints are observed in some case. At 8 pl, for example, the discharge directions are caused to fluctuate in particular. Also, in the 600 dpi, the discharge amount is more or less 20 pl, but in 1,200 dpi, it becomes 8.5 pl to bring about the conspicuous twisting. For the minute ink droplets, it is preferable to suppress the twisting itself to approximately a half of the allowable twist of the ink discharges in 600 dpi, for example. However, in some cases, it is still observed that the twisted condition is beyond this range.

Particularly, when the discharge amount is set at 8.5 pl, it is observed that discharge is directed completely different after the head is left intact for several minutes. This tendency is proportional to the amount of resultant elution of polyol to ink, and the print quality is degraded accordingly.

Here, also, in order to stabilize the discharges, the application of energy (voltage and pulse width) should be increased. Then, the twisted ink droplets become more noticeable eventually.

Further, the temperature of heater substrate rises as the number of printing sheets becomes more. Then, twisting is increased.

Also, the method for sucking ink or wiping off the eluted substance periodically together with ink makes it possible to reduce the eluted substance in the flow paths, but it is still difficult to remove the eluted substance which has adhered to the orifice surface. As a result, it is difficult to improve all the twisting conditions that may be caused by the deviated direction of discharges.

Moreover, even with the execution of the sucking operation, there are some cases where twisting becomes noticeable after having printed on only one A3-sized sheet. Therefore, suction should be executed more often, which necessitates the provision of the increased capacity of a waste ink retaining container after all. Also, in order to enhance the printing speed, the discharge frequency should be increased to 20 kHz as currently required from the conventional frequencies of 8 to 10 kHz, for example. Then, the temperature of the heater substrate is caused to rise earlier and increase the twisting still more.

Also, while a tendency of the kind being confronted, it has been demanded to reduce the replacement frequency of ink retaining containers. As a result, the size of the ink retaining container has become larger inevitably, and the ink absorbent installed in it has also become larger accordingly. The amount of eluted substance tends to be increased under the circumstances.

SUMMARY OF THE INVENTION

The present invention is designed with a view to solving the problems discussed above. It is an object of the invention to provide an adsorption member for ink jet use to make the ink jet recording possible with excellent print characteristics by removing the eluted substance form the ink absorbent effectively, and also, to provide the adsorbent used therefor, as well as an ink retaining container or an ink jet head provided with them, and an ink supply system using such ink retaining container or ink jet head.

In accordance with the present invention, it is possible to print clearly and precisely even when using the ink retaining container provided with the polyurethane absorbent which creates impurities, such as polyol or silicon interfacial active again, or some other active agent, foaming agent, higher alcohol, catalyzer; or the absorbent formed by polypropylene fabric which elutes higher hydrophobic substance, such as higher fatty acid and its derivatives, or the ink absorbent formed by the melamine resin, polyester, nylon, elastomer, or cellulose, which elutes some other hydrophobic substance. Further, in accordance with the present invention, it becomes possible to eliminate the rinsing process for the ink absorbent in the manufacture steps required for the formation of an ink retaining container.

It is still another object of the invention to provide an adsorbent for ink jet use arranged in a position to be in contact with ink, having the higher capability of adsorption with respect to hydrophobic substance contained in ink than colorant therein.

It is a further object of the invention to provide an ink retaining container which comprises an ink retaining portion for retaining ink to be supplied to an ink jet head; an ink supply opening becoming the ink supply portion from the ink retaining portion to the head; an atmospheric communication opening for communicating the ink retaining portion with the air outside. This ink retaining container is provided with an adsorption member arranged in a position to be in contact with ink in the ink retaining container, having the higher adsorption capability with respect to the hydrophobic substance contained in ink than the colorant herein.

It is still a further object of the invention to provide an ink supply system which comprises an ink jet head; an ink retaining container provided with the ink retaining portion to retain ink to be supplied to the ink jet head, and the ink supply opening becoming the ink supply portion from the ink retaining portion to the head, as well as with the atmospheric communication opening to communicate the ink retaining portion with the air outside; and ink supply paths which communicate the ink jet head with the ink retaining container. This adsorption member is arranged in a position to be in contact with ink in either in the ink jet head, the ink retaining container, or the ink supply paths, having the higher capability of adsorption with respect to the hydrophobic substance contained in ink than the colorant contained therein.

It is another object of the invention to provide an ink jet recording apparatus capable of recording with the ink supply system described in the preceding paragraph, which is mounted on the apparatus. This recording apparatus is provided with the recovery mechanism for exhausting ink from the ink supply system at specific timing to maintain and recover the ink discharge condition, and executing the initial recovery by exhausting ink in an extremely minute quantity at least when the ink retaining container of the ink supply system is replaced.

BRIEF DESCRIPTION OF THE DRAWINGS

FIG. 15A is the schematic view and FIG. 15B is an enlargement of the portion 15B encircled with dotted line in FIG. 15A.

DETAILED DESCRIPTION OF THE PREFERRED EMBODIMENTS

Figure 1:
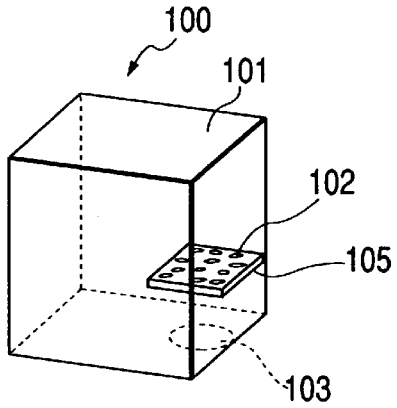
FIG. 1 is a view which shows the type of a member for adsorbing eluted substance for use of an ink jet head in accordance with the present invention.

The capability required for the adsorption member of the present invention for use of ink jet performance (hereinafter simply referred to as an adsorption member) is as follows:

1. The adsorption member should be able to adsorb only the eluted substance having hydrophobic property, but not to adsorb colorant (dyestuffs).
2. It is insoluble by ink.
3. It does not present any resistance to fluid, which may impede the recording performance.
4. It demonstrates its effect with a small amount of use.

Here, the hydrophobic substances, with which the present invention should deal as a problem to be solved, are polyol, active agent, catalyzer, plastic agent, neutralizer, lubricant, unreacted substances, thermally decomposed substances at the time of manufacture, and the hydrolytic substances thereof, such as those having lower degree of solution to ink, which are partly eluted at least from either one of the ink absorbent, the ink retaining container, and the ink supply route such as supply paths.

(Adsorbent)

At first, the description will be made of the adsorbent used for the adsorption member of the present invention. The adsorbent used for the adsorption member is also required to satisfy the above-mentioned conditions that (1) it can adsorb only the eluted substance having the hydrophobic property but not to adsorb any colorant (dyestuffs), (2) it is insoluble by ink, and (4) it can demonstrate its effect with a small quantity of use.

The adsorption factor with respect to colorant is obtainable from the absorbance before and after the addition of such adsorbent to the colorant solution. On the other hand, the adsorption factor with respect to the hydrophobic substance is obtainable by means of determination using liquid chromatography before and after the addition of the adsorbent to the solution containing the hydrophobic substance. Therefore, by an experiment of the kind, it is possible to select an adsorbent which shows the higher degree of adsorption with respect to the hydrophobic substance than to the colorant contained in ink.

Here, therefore, the inventions hereof have examined various adsorbents to arrive at the conclusion that as the adsorbent of the present invention, it is particularly preferable to adopt the silica gel having hydrophobic group induced onto the surface thereof or the polymer having hydrophobic group induced onto the side chain thereof, and the poly (metha)acrylic acid ester resin with the crosslinked porosity or the crosslinked polystyrene resin.

Now, at first, the description will be made of the silica gel having hydrophobic group inducted onto the surface thereof, and the polymer having hydrophobic group inducted onto the side chain thereof as well.

For the hydrophobic groups induced onto the surface of the silica gel or the side chain of the polymer, it is preferable to select at least one kind from among the long chained alkyl group, allyl group, trialkylsilyl group, and cyanoalkyl group.

As the long chained alkalykil group, there is named C8 to C24 alkyl group, such as octyl group or octadecyl group. The C8 to C18 alkyl group is preferable. Also, as the allyl group, phenyl group or alkyl displacement phenyl group can be named, for example. As the trialkylsilyl group, trimethylsilyl group can be named, for example. As the cyanoalkyl group, cyanopropyl group can be named, for example.

Of these groups, it is particularly preferable to use the C8 to C18 alkyl group and the phenyl group as the hydrophobic group which is induced onto the side chain of polymer. It is most preferable to use octadecyl group and phenyl group. Also, as the hydrophobic group which is induced onto the surface of the silica gel, it is particularly preferable to use the C8 to C18 alkyl group and phenyl group, and most preferable to use octadecyl group.

The crosslinked poly (metha)acrylic acid ester resin is such that the principal chain of the poly (metha)acrylic acid ester is crosslinked by an appropriate crosslinking agent. It may be possible to contain other appropriate copolymeric compound which is not opposed to the objective of the present invention.

The crosslinked polystyrene resin is such that the principal chain of the polystyrene is crosslinked by an appropriate crosslinking agent. It may be possible to contain other appropriate copolymeric compound, which is not opposed to the objective of the present invention. For example, it is preferable to use styrene divinyl benzene which is the copolymeric compound prepared by adding divinyl benzene to styrene.

It is preferable to make the surface area as large as possible both for the crosslinked poly (metha)acrylic acid ester resin and crosslinked polystyrene resin. It is particularly preferable to prepare them to be porous having voids communicated with the outside. Also, as its configuration, it is preferable to prepare them to be granular.

As the adsorption mechanism of the silica gel having hydrophobic group induced onto its surface and the polystyrene resin having hydrophobic group induced onto its side chain, it is conceivable that the hydrophobic substance eluted from the absorbent not only enters the fine holes of the silica or polymer itself, but also, it is adsorbed to the hydrophobic group provided for the polymer or silica gel.

The granular diameter of the polymer or silica gel to which hydrophobic group is induced may be selected arbitrarily depending on the location to which the eluted substance absorber is applied, but the larger the better in consideration of the fact that it should be held in the flow path where resistance is created or in the absorbent itself. Then, it is preferable to use the one having 10 $\mu$m to 1,000 $\mu$m diameter each. If it is smaller than 10 $\mu$m, it takes time for ink to pass, and the follow-up capability of ink is lost, thus being subjected to the condition of ink shortage more often.

For the crosslinked poly (metha)acrylic acid ester resin having hydrophobic group induced onto the side chain or polystyrene resin, it is possible to name those available on the market, such as ARP-ODP 130 (manufactured by: Asahi Kasei Kogyo K.K.). Also, for the synthesized poly (metha) acrylic acid ester resin or polystyrene resin, it may be possible to synthesize such resin by the reaction of hydrophobic group induction, such as to prepare the resin with octadecyl, phenyl, octyl, trimethylsilyl, syanopropyl, or the like. In this case, it may be possible to effectuate the reaction of hydrophobic group induction easily if the reactive group is induced in advance to the poly (metha)acrylic ester resin or polystyrene resin. Also, it is possible to synthesize them as monomer by polymerizing or copolymerizing those having hydrophobic group.

Also, as the example of silica gel, there can be named ODS-BU0010MT, ODS-BU0015MT, ODS-BU0020, ODS-BU1530MT, ODS-BU3050MT, ODS-DU0010MT, ODS-DU0015MT, ODS-DU1530MT, ODS-DU3050MT, ODS-EU0010MT, ODS-EU0015MT, ODS-EU0020, ODS-EU1530MT, ODS-EU3050MT, ODS-FU0010MT, ODS-FU0015MT, ODS-FU1530MT, ODS-FU3050MT (so far, manufactured by: Fuji Devidson Chemicals, Inc.), Sk-GEL ODS (manufactured by: Soken Kagaku K.K.), ODS-L (manufactured by: Showa Denkou K.K.) among some others.

The above-mentioned porously crosslinked poly (metha) acrylic acid ester resin or crosslinked polystyrene resin may present a problem that the flow path resistance is heightened when eluted substance is adsorbed to such resin, because volumetric expansion takes place. As a result, the smaller the granular diameter of a polymer of the kind, the better. It is preferable to use the polymer whose granular diameter is 10 to 300 $\mu$m.

As one example of such polymer, there is Diaion HP20, HP21, HPMG, HP20SS, Sepabeaze SP825, SP850, SP207, SP20SS (so far, manufactured by Mitsubishi Chemicals K.K.), DuoliteS-861, S-862, S876, ES-866 (manufactured by: Sumitomo Chemicals K.K.).

As described above, it may be possible to use any one of the silica gel having the hydrophobic group inducted onto the surface thereof, the polymer having the hydrophobic group induced onto the side chain thereof, the porously crosslinked poly (metha)acrylic acid ester resin, or the crosslinked polystyrene resin individually, but it may be possible to combine them as needed.

In accordance with the present invention, the required amount of adsorbent is determined by the amount of the hydrophobic substance eluted from the absorbent or the respective members or by the kind of a printer head to be used.

Also, the amount of elution of the hydrophobic substance is different depending on the kinds of the material or the method of manufacture of the absorbent and those of the respective members.

The required amount of adsorbent should be different depending on the size of discharging liquid droplet or the structure of ink flow paths even if the member or the like having the same amount of elution of the hydrophobic substance is adopted.

The adsorbent described above is reusable, because after adsorption, the eluted substance can be cleaned off from it with the alcoholic cleaning treatment.

(Adsorption Member)

The adsorption member of the present invention is the adsorbent itself or a member formed by a part that carries the adsorbent. The adsorption member of the present invention contains the adsorbent in such a mode that its adsorption capability is not impeded very much. Further, the adsorption member is in a mode that it can be in contact with ink easily, but it is formed or arranged so as not to impede the flow of ink.

The adsorption member is able to take various modes depending on the positions of its arrangement. For example, the mode may be such as to use the aforesaid absorbent as it is; to use it in a suitable container; or to use it in the form of pellet or sheet. Furthermore, the mode may be such that the absorbent is carried on a supporting element (including carrier, dispersion, or the like) if necessary.

FIG. 1 shows the example of the mode in which the absorbent is used as it is. A part of the ink absorbent 101 formed by polyurethane or the like in an ink tank 100 is provided with a cut, and then, the granular adsorbent itself is sandwiched by the sections 105 thus cut. Reference numeral 102 denotes ODS silica gel (adsorption member). In this case, it is preferable to set the position of the member for adsorbing eluted substance above the ink supply opening, but not too far away from it. In accordance with such mode, it becomes possible to adsorb the eluted substance easily with the simple structure whereby to sandwich the adsorbent itself between the cut sections provided for the absorbent itself.

Figure 2:
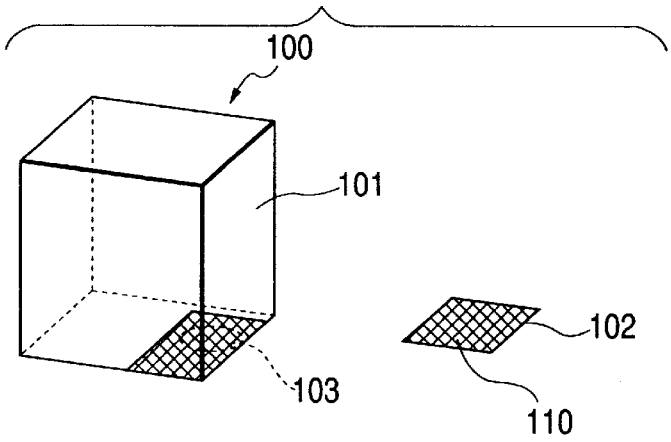
FIG. 2 is a view which shows the type of a member for adsorbing eluted substance for use of an ink jet head in accordance with the present invention.

FIG. 2 shows the example of the mode in which the adsorbent is wrapped with unwoven fabric. There is no particular restriction as to the unwoven fabric, but it may be possible to use the one formed by nylon, polypropylene, polyurethane, elastomer, or the like. Also, it is preferable to use the one which is manufactured by the method using spun bond, spun lace, needle punch, melt blow, or the like which does not use any binder. It is particularly preferable to adopt the melt blow method for its manufacture, because with this method extremely fine holes can be provided uniformly.

For example, as shown in FIG. 2, it is possible to position the member for adsorbing eluted substance in a mode that the adsorbent is wrapped with the unwoven fabric as described above so that it can be located below the ink absorbent 101 to cover the ink supply opening 103. Here, as shown in FIG. 1, it may be possible to insert this member into the cut sections of an ink absorbent. Reference numeral 102 denotes ODS silica gel (adsorption member). Reference numeral 110 denotes nylon mesh or unwoven fabric of polyester.

As in this mode where the adsorbent is wrapped with the unwoven fabric, it becomes easier to handle the adsorption member, leading to the enhanced productivity. Also, there is no possibility that adsorption performance and ink supply capability are impeded.

Figure 3:
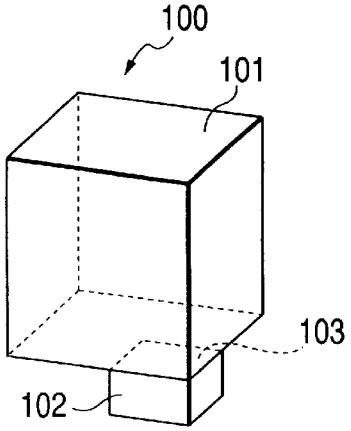
FIG. 3 is a view which shows the type of a member for adsorbing eluted substance for use of an ink jet head in accordance with the present invention.

FIG. 3 shows one example of the mode of the adsorption member in which the adsorbent is housed in a container in the form of a pretank. It is possible to use the adsorbent filled in such an appropriate container on the way of ink flow paths where such container is directly connected with the ink retaining container as shown in FIG. 3, for example. In pretank 102, ODS silica gel is filled. If such container is arranged separately from the ink retaining container, it becomes possible to replace only adsorbents.

Figure 4:
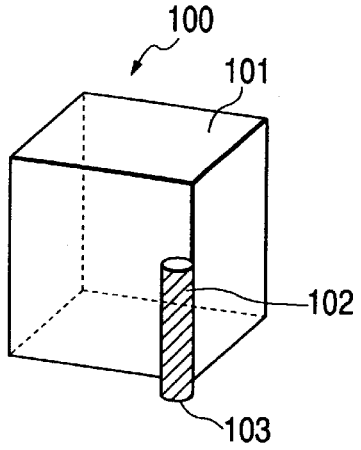
FIG. 4 is a view which shows the type of a member for adsorbing eluted substance for use of an ink jet head in accordance with the present invention.

FIG. 4 shows one example of the mode in which the adsorbent is filled in a column. The filled adsorbent is ODS silica gel. The bottom end of the column is positioned in the vicinity of the ink supply opening in the ink retaining container. Then, not only it becomes possible to adsorb eluted substance reliably, but also, to enhance the ink supply performance.

Figure 5:
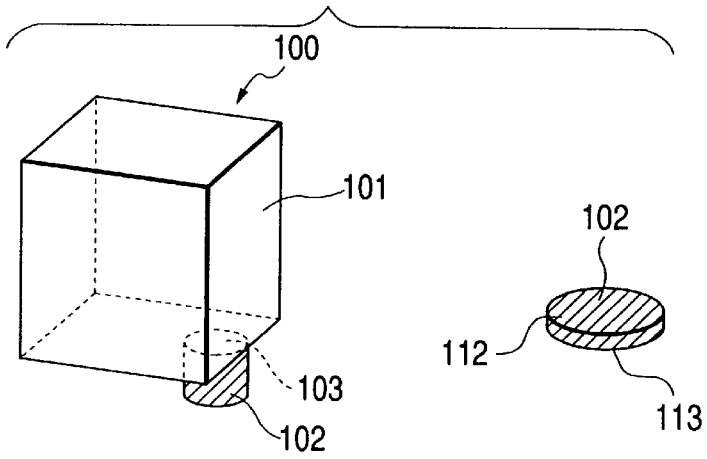
FIG. 5 is a view which shows the type of a member for adsorbing eluted substance for use of an ink jet head in accordance with the present invention.

FIG. 5 shows the example of the mode in which the adsorbent is filled in a filter or in a pressure contact member. This mode makes it possible to form an adsorbent with the filters or the pressure contact members 112, 113 that sandwich the adsorbent. The pressure contact member is one way fabric formed by polypropylene, polyethylene, polyester, nylon, or the like, felt, or unwoven fabric, and arranged on the supply opening portion to promote the stabilized ink induction.

Figure 6:
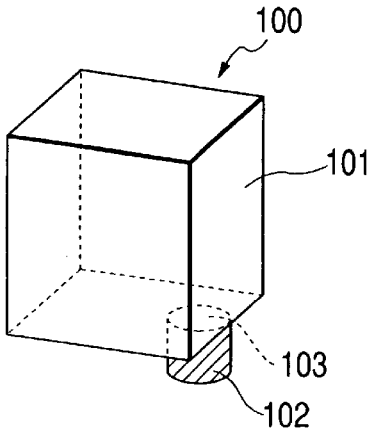
FIG. 6 is a view which shows the type of a member for adsorbing eluted substance for use of an ink jet head in accordance with the present invention.

FIG. 6 shows one example of the mode in which the adsorbent is prepared in the form of pellet or cylinder. As shown in FIG. 6, the adsorbent is solidified in the cylindrical form to make it dually functional as the pressure contact member 102. In accordance with this mode, the adsorbent dually functions as the pressure contact member (solidified ODP) itself. As a result, its handling becomes easier, and also, its reuse becomes possible as described later.

Figure 7:
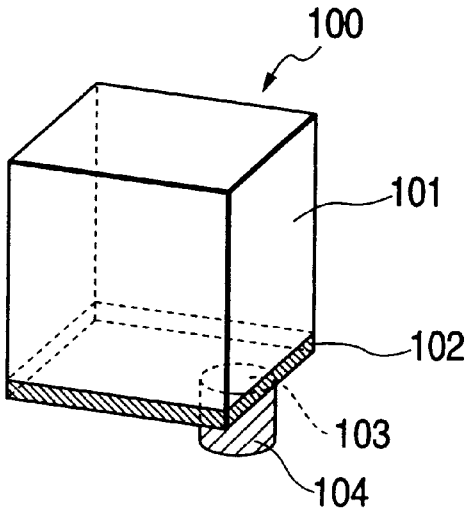
FIG. 7 is a view which shows the type of a member for adsorbing eluted substance for use of an ink jet head in accordance with the present invention.

FIG. 7 shows one example of the mode in which the adsorbent is prepared in the form of sheet. The sheet type adsorbent can be arranged below the ink absorbent for use. As in this mode, the adsorption member 102, which is a sheet of solidified ODP is arranged on the liquid surface portion of the ink tank 100 above the pressure contact member 104. Then, it becomes possible to allow the adsorption member to be in contact with ink over a large area, while saving the space, for an efficient adsorption. Also, it is easier to process the adsorption member in an appropriate size.

Figure 8:
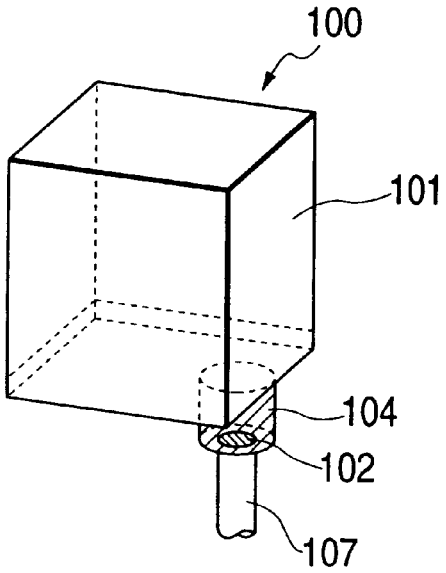
FIG. 8 is a view which shows the type of a member for adsorbing eluted substance for use of an ink jet head in accordance with the present invention.

FIG. 8 shows one example of the mode in which the adsorbent is prepared in the form of sheet or pellet. As shown in FIG. 8, the adsorbent is solidified in the form of sheet or pellet to allow the member for adsorbing eluted substance to dually function as a filter, which is made by solidifying ODP.

Figure 9:
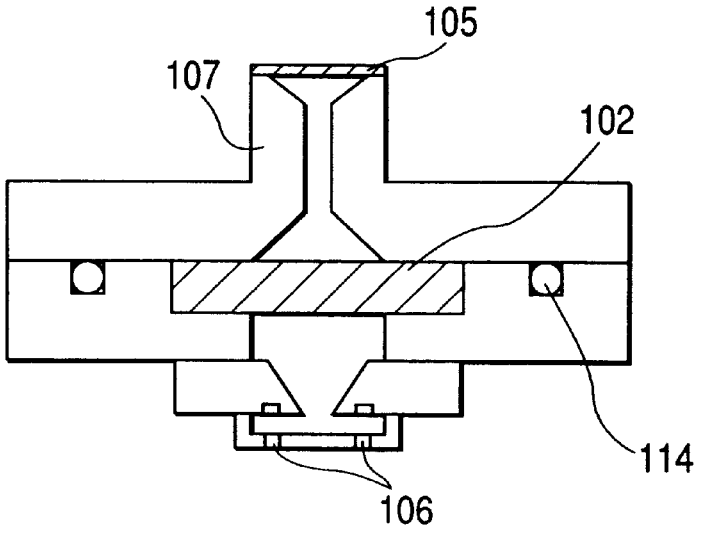
FIG. 9 is a view which shows the type of a member for adsorbing eluted substance for use of an ink jet head in accordance with the present invention.

FIG. 9 shows the example in which the adsorbent prepared in the form of sheet or pellet is installed in the ink supply route of the head for use. In this mode, the filter 105 is provided for the leading end of the ink supply tube 107 which is inserted into the ink 100. On the way to the nozzles 106, the adsorption member 102 (ODP cartridge) is arranged. Here, it may be possible to make the adsorbent exchangeable. Reference numeral 114 is seal member.

Figure 10:
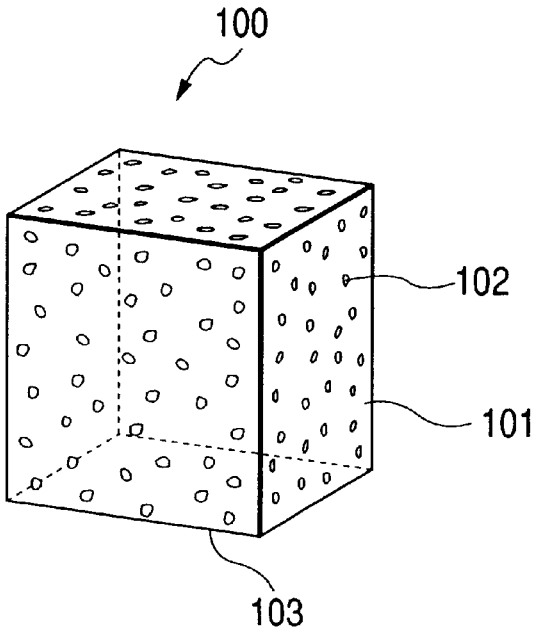
FIG. 10 is a view which shows the type of a member for adsorbing eluted substance for use of an ink jet head in accordance with the present invention.

FIG. 10 shows the example of the mode in which the adsorbent is dispersed in the entire body of the ink absorbent 101 for use. It is possible to obtain this mode by kneading the adsorbent into the ink absorbent in the process of manufacture, such as synthesizing the ink absorbent, foaming, spinning, and then, by means of pressurized contact (fusion contact). Reference numeral 102 denotes the adsorbent member of ODS silica gel.

Further, it is possible to provide the adsorbent for the inner surface of a pouch member that contains ink directly, for example, by means of fusion bonding or the like. Also, such mode may be arranged so as to place the absorbent prepared in the sheet form on the ink outlet opening of the pouch member, thus supplying ink to the head after having passed the sheet.

Also, the mode in which ink is directly contained is not necessarily limited to the pouch type as described above. For example, this arrangement is applicable to the mode in which ink is directly contained in a resin mold formation (ink tank) using polypropylene or the like. The adsorbent may be kneaded into the resin which the ink tank is formed; the adsorbent prepared in the sheet form is adhesively bonded to the inner wall surface of the resin ink tank, or the inner wall surface thereof may be processed with the inner wall treatment agent in which the adsorbent has been dispersed, among some others. Furthermore, the adsorbent may be held on a part of ink tank without being in contact with ink, and then, this non-contact status of adsorbent is released immediately before the ink tank is used, thus the adsorbent is added to ink or the structure is arranged so that the adsorbent is added directly to ink immediately before the ink tank is used, among some other modes.

Further, since the structure where ink is contained directly in the container adopts a method whereby to supply ink from the ink retaining container to the recording head by connecting them with the ink tube, it may be possible to arrange the adsorbent at the leading end of the supply tube, to disperse the adsorbent on the inner surface of the supply tube, or to process the inner surface of the supply tube with the adsorbent, among some others.

With the adoption of a mode of the kind, it becomes possible to remove the hydrophobic insoluble substance which is eluted from the ink retaining container (the pouch or resin container).

For the examples shown in FIG. 1 to FIG. 10,.the silica gel (ODS silica gel) having the octadecyl group induced onto the surface thereof or the polymer (ODP) having the octadecyl group induced onto the side chain thereof are used. The present invention, however, is not necessarily limited to it.

(The Embodiment of the Ink Retaining Container)

Now, with reference to FIGS. 11A and 11B and FIG. 12, the description will be made of one example of the ink retaining container in accordance with the present invention.

At first, the ink tank 10 serving as an ink retaining container is formed to be substantially rectangular parallelepiped, and an atmospheric communication opening 12 is arranged on the upper wall 10U thereof, which is a hole open to the interior of the ink retaining container.

This atmospheric communication opening 12 is formed by means of injection molding. Then, in general, the diameter is approximately 1 mm. The evaporation of ink is a kind of dispersive phenomena, and is increased in proportion to its passage with dispersion. Then, it is reduced in proportion to the square of the distance of dispersion. Therefore, although not shown, the groove connected with the atmospheric communication opening 12 is, usually, zigzagged or prepared in the form of labyrinth on the upper wall 10U. Then, a film member is adhesively bonded by means of thermal fusion or the like to the upper wall 10U of the ink tank 10 so as to make the atmospheric communication passage long and complicated.

In this way, the evaporation amount of ink can be reduced to $1/1000$ to $1/10000$ as compared with the case where the air conduit hole 12 is open to the air outside directly.

Also, on the lower wall 10B of the ink tank 10, the ink supply cylinder 14 is formed with the ink supply opening as an liquid supply opening for use of discharges in the mode in which the opening has been extruded cylindrically. Then, the atmospheric communication opening 12 is closely covered by film sheet or the like during its distribution for safety. Also, the ink supply cylinder 14 is closely covered by a cap serving as the closing member of the ink supply opening.

Here, a reference numeral 16 designates the lever member which is integrally formed to be elastically deformable on the outer side of the ink tank 10. On the intermediate portion thereof, a hooking extrusion is formed.

A reference 20 designates the tank case formed integrally with the head to allow the ink tank 10 to mounted therein. In accordance with the present embodiment, the tank case receives each of the tanks 10 (10C, 10M and 10Y) for use of colors, cyan C, magenta M, and yellow Y, respectively, for example. On the bottom end of the tank case 20, a color ink jet head 22 is integrally formed. For the color ink jet head 22, a plurality of discharge openings (ports) are formed downward (hereinafter, this head face where discharge openings (ports) are formed is referred to as the discharge opening formation surface).

Figure 11A:
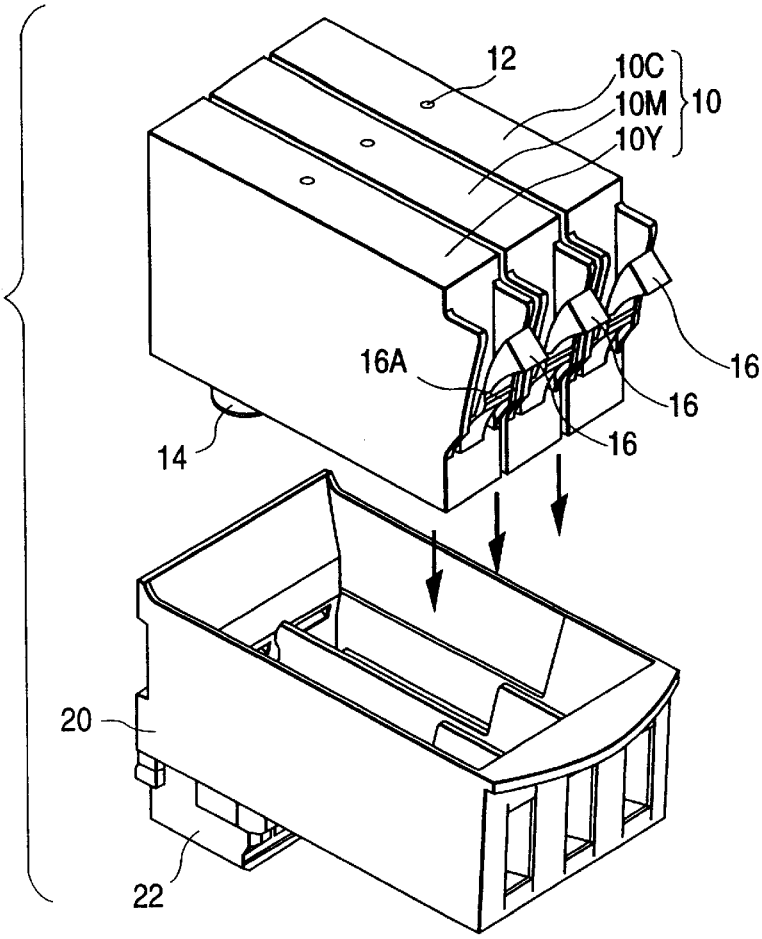
FIGS. 11A and 11B are views which illustrate the ink retaining containers that adopt the member for adsorbing eluted substance for use of an ink jet recording head in accordance with the present invention.
Figure 11B:
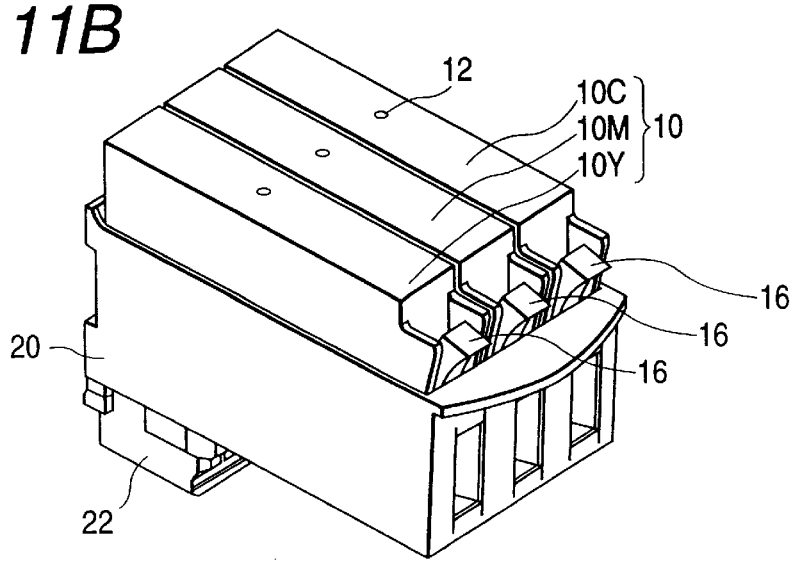

Then, from the state shown in FIG. 11A, the ink tank 10 is pressed into the ink tank case 20 which is integrally formed with the head so that the ink supply cylinder 14 engages with the unit (not shown) of the color ink jet head 22, which receives the ink supply cylinder 14. Then, the ink passage cylinder of the color ink jet head 22 is depressed to enter the ink supply cylinder 14. Thus, the hooking extrusion 16A of the lever member 16 engages with the coupling unit formed in the specific position of the tank case 20 having the head integrally formed with it to obtain the regular mounting posture as shown in FIG. 11B. Here, the tank case 20 integrally formed with the head, which is now in the state of having the ink tank 10 mounted therein, is further mounted on the carriage of an ink jet recording apparatus (not shown), hence being ready to print. In this state, then, a specific difference of water level H is formed between the bottom end of the ink tank 10 and the discharge opening formation surface of the head.

Now, with reference to FIG. 12, the inner structure of the ink tank 10 will be described.

The ink tank 10 of the present embodiment is partitioned by the partition wall 38 into the chamber 34 that contains the negative pressure generating member with its upper part communicated with the air outside through the atmospheric communication opening 12, and with its lower part communicated with the ink supply opening, having in the interior thereof the ink absorbent 32 which serves as the negative pressure generating member, and the liquid chamber 36 which is substantially closed airtightly. Then, the chamber 34 which contains the negative pressure generating member in it and the liquid chamber 36 are communicated only through the communication path 40 formed on the partition wall 38 near the inner bottom of the ink tank 10.

On the upper wall 10U of the ink tank 10 that defines the chamber 34 for the negative pressure generating member, several numbers of ribs 42 are integrally formed to extrude into the interior of the tank to abut upon the absorbent 32 retained in the chamber 34, which functions as the negative pressure generating member in a state of being compressed. Then, the air buffer chamber 44 is formed between the upper wall 10U and the upper surface of the absorbent 32. The absorbent 32 is prepared by the thermally compressed urethane foam. As described later, it is retained in the chamber 34 to be the negative pressure generating member in such a manner as to create a specific capillary force. The absolute value of the poise size of the absorbent that should create the specific capillary force is different depending on the kind of ink to be used, the dimensions of the ink tank 10, the position of the discharge opening formation surface of the ink jet head 22 (the water level difference H), and some others. However, such size should be good enough to create a large capillary force than that created in the capillary force generating groove or path. For that matter, the minimum requirement of the poise size is approximately 50 pieces/inch or more.

Also, in the ink supply cylinder 14 which forms the ink supply opening 14A, the disc or cylindrical pressure contact member 46 is arranged. The pressure contact member 46 is formed by polypropylene felt, for example, and this member is not easily deformed itself by the external force. In FIG. 12 which shows the pressure contact member 46 before being installed in the tank case 20, this member is held in a state where it is pressed into the absorbent 32 so as to locally press the absorbent 32. To this end, therefore, the flange 14B is formed on the edge portion of the ink supply cylinder 14 to be in contact with the circumference of the pressure contact member 46, hence preventing this member from falling off externally.

Figure 12:
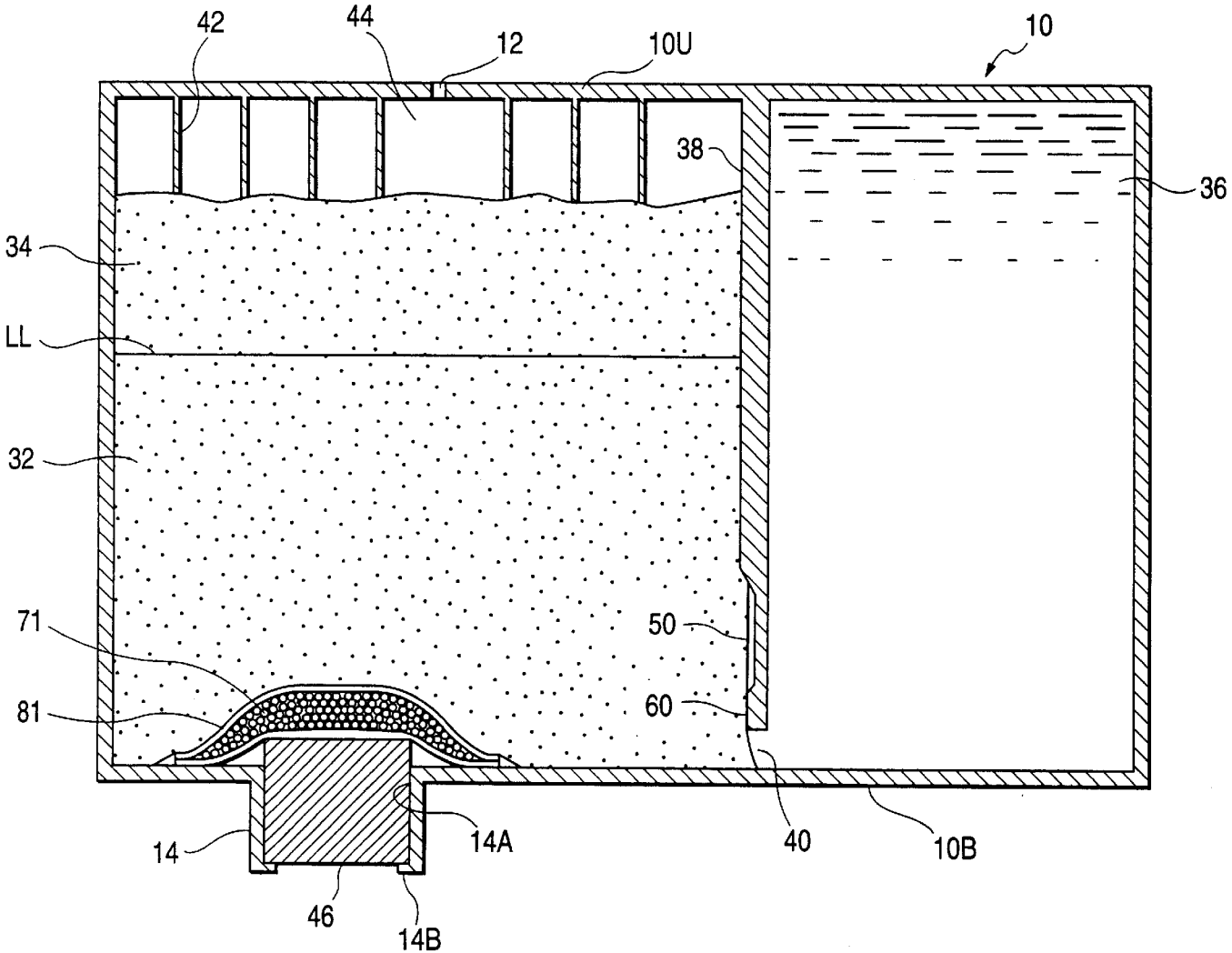
FIG. 12 is a view which illustrates an ink retaining container that adopts the member for adsorbing eluted substance for use of an ink jet recording head in accordance with the present invention.

As shown in FIG. 12, on the pressure contact member 46 there is arranged in accordance with this example, the member for adsorbing eluted substance, which serves as the adsorbent 71 prepared in the mode where the polymer having octadecyl group on the side chain is wrapped with the unwoven fabric 81. Here, it is preferable to arrange this member so that the adsorbent can cover the entire area of the supply opening.

(The Arrangement Position of the Adsorption Member)

The adsorption member of the present invention is arranged in a position where it is in contact with ink. In accordance with the present invention, the adsorption member is arranged in the ink retaining container and ink supply member. Here, the ink supply member means all the members which reside in the ink flow paths extended to the nozzles with the exception of the ink retaining container. For example, these are the ink supply tubes (ink supply route), the common liquid chamber, the filters arranged en route the ink flow paths, the pressure contact member, and the like.

Now, in conjunction with FIG. 13, the description will be made of the arrangement position of the adsorbent, as well as its effect, further in detail.

Figure 13:
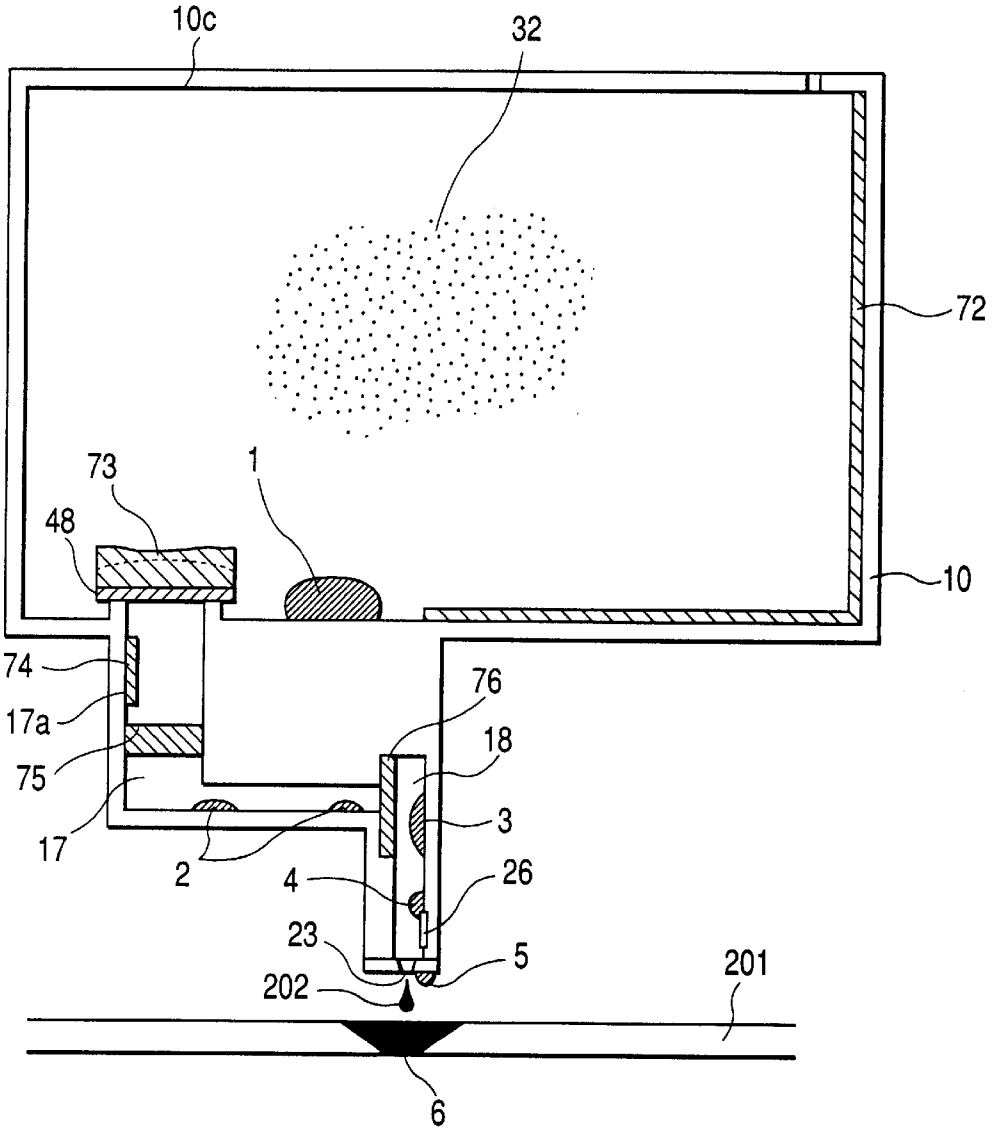
FIG. 13 is a view which schematically shows each of the positions where the eluted substance adheres, and the problem related thereto, as well as each arrangement position of the member for adsorbing eluted substance for use of an ink jet head.

FIG. 13 is a view which schematically shows the position where the eluted substance adheres and the related problems, as well as the arrangement position of the member for adsorbing eluted substance, which is made with a view to solving such related problems.

The eluted substance 1 is the substance eluted from polyol, plastic agent, active agent, catalyzer, lubricant, neutralizer, or the like which has adhered to the wall face of the ink tank 10. In order to remove such eluted substance, the adsorption member 72 prepared in the sheet form is arranged on the tank wall, the sheet or pellet type adsorption member 73 is arranged above the filter 48 of the supply opening, or the filter is made to be dually functional as the adsorption member. Also, the adsorption member is arranged to be inserted into the ink absorbent 32 or dispersed in it or with the structure or arrangement made as described in the paragraphs of the "The Adsorption Member". In this manner, it is attempted to solve this problem of the adhesion of eluted substance.

The eluted substances 2 are those from the polyol, the plastic agent, or the like that has adhered to the ink supply path 17 between the ink retaining container and the ink jet head. If any eluted substance adheres to the ink supply path 17, such substance is carried over to the orifice 23 to create the problems related to ink discharges. In addition, such adhesion may impede the ink flow so that the refilled ink becomes smaller to cause disabled discharges or the fluctuation of discharged amount, resulting in the creation of faint and patchy images in some cases.

In order to suppress the adhesion of the eluted substance to the ink supply path 17, the sheet type member 74 for adsorbing eluted substance is arranged on the wall 17*a* of the supply path, for example. Also, it may be possible to arrange in the ink supply path 17 the pellet or disc type member 75 for adsorbing eluted substance, whose outer configuration has been prepared to be the same as the ink supply path 17.

The eluted substance 3 is that of the polyol, the plastic agent, or the like that has adhered to the common liquid chamber 18 of the ink jet head. If any eluted substance adheres to this portion, it is carried over to the orifice 23 to create the problems related to ink discharges. Besides, it impedes the ink flow, and then, the refilled ink becomes short to cause disabled discharges or the fluctuation of discharged amount, resulting in the creation of faint and patchy images in some cases.

In order to suppress the adhesion of the eluted substance to the common liquid chamber 18, the pellet or disc type member 76 for adsorbing eluted substance is arranged on the entrance portion between the ink supply path 17 and the common liquid chamber 18, for example. In this way, this problem of adhesion can be solved.

The eluted substance 4 is that of the polyol, the plastic agent, or the like that has adhered to near the discharge pressure generating unit 26. The discharge pressure generating unit is formed by the electro-thermal converting members, such as heat generating resistors, the piezoelectric devices which generate mechanical energy exerting the discharge pressure instantaneously, or the like. Therefore, if the polyol or the like that has been eluted from the urethane form adheres to the vicinity of the discharge pressure generating unit 26 as granular particles, the discharges become unstable and cause the discharge direction to be deviated or result in the refilling shortage to cause the fluctuation of discharge amount, hence creating the problem of print unevenness in some cases.

The eluted substance 5 is that of the polyol, plastic agent, active agent, catalyzer, lubricant, neutralizer, or the like, which has adhered to the orifice surface in the vicinity of the orifice 23. If, for example, stearin acid or some other higher fatty acid is bound with the water-repellent agent on the orifice surface, the water-repellency is lost, hence creating the problem of deviated direction of discharges.

Also, the eluted substance 6 is the one discharged onto the recording sheet 201 together with ink droplet 202 together, hence creating the problems of spreading on the recording sheet, the excessive permeability to the backside of the recording sheet, or the problem of lowered density in some cases.

In order to avoid the occurrence of the eluted substances 4, 5, and 6, the member for adsorbing eluted substance should be arranged in the position upstream the ink flow path. Then, a problem of the kind can be solved.

Even when any particular reference is not made in the above description, the member for adsorbing eluted substance arranged on the upstream portion of the ink flow path can produce effect of preventing the eluted substance from adhering to the downstream portion thereof.

Here, the description, which has been made in conjunction with FIG. 13, is also applicable to the mode in which ink is directly retained in the pouch type container or in the resin mold formation (ink tank) using polypropylene or the like as described earlier with respect to the ink tank mode that contains ink directly. Also, since the structure is adopted for this mode to connect the ink retaining container and the recording head by use of ink tube, it is possible to apply the aforesaid method whereby to provide the adsorbent for the supply tube or the like.

Figure 14:
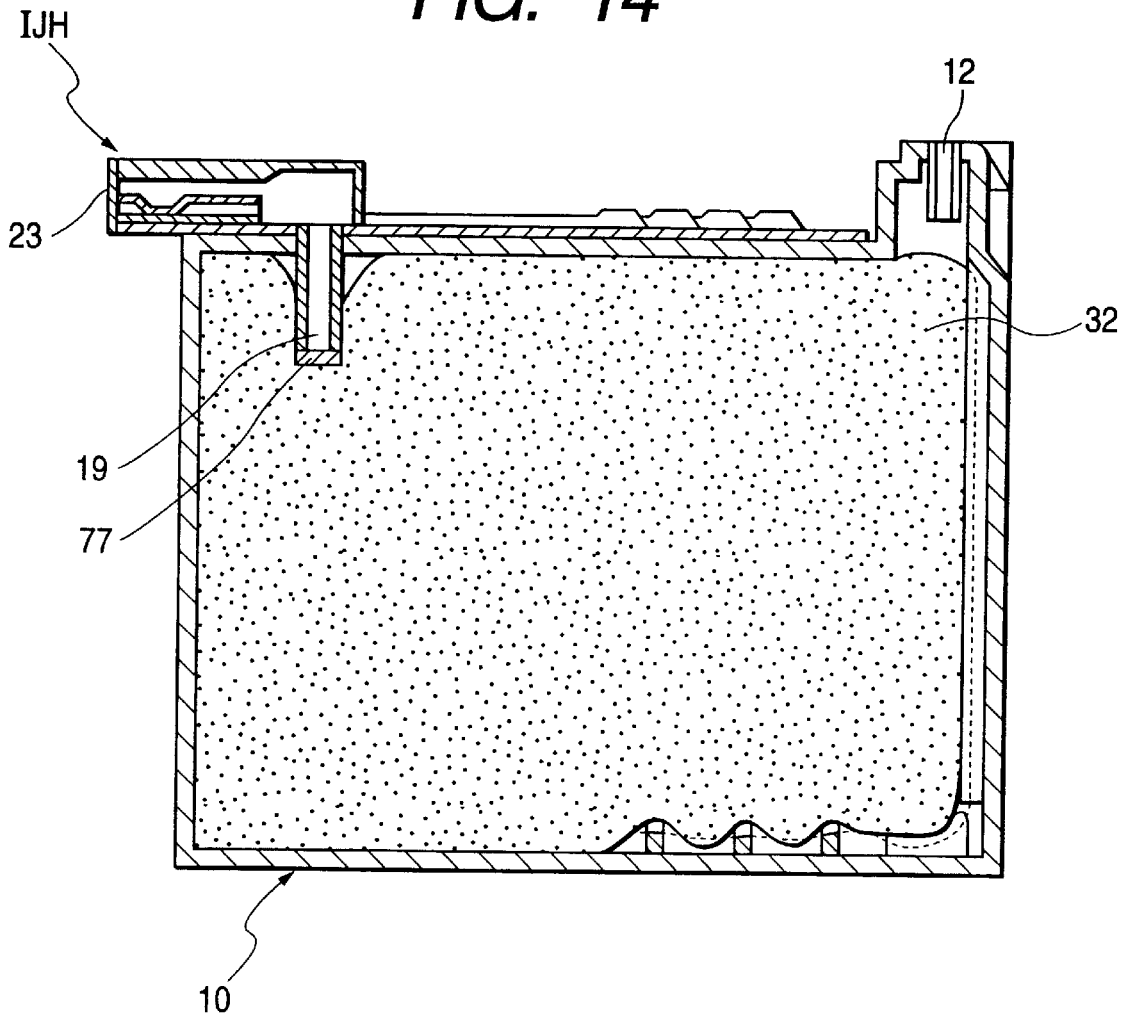
FIG. 14 is a view which illustrates the case where the member for adsorbing eluted member of the present invention is applied to an ink jet recording head of the type that an ink retaining container is directly connected with the head.

Now, in conjunction with FIG. 14, the description will be made of an ink jet recording head wherein the ink jet head and an ink retaining container are integrally formed and connected directly with each other.

This ink jet recording head is formed in such a manner that an ink jet recording head IJH, which is provided with the ink supply tube 19 mounted on the ink tank 10 with its ink supply tube inserted into the ink tank. In FIG. 14, the member for adsorbing eluted substance which dually serves as the filter is arranged for the entrance portion of the ink supply tube 19. Also, it may be possible to insert into the ink absorbent 32 an adsorbent to adsorb the eluted substance or to disperse it in the ink absorbent. As far as the position of arrangement is allowable, it is possible to use the structure and arrangement of the member for adsorbing eluted substance in the ink flow paths from the interior of the ink tank 10 to the orifice surface 23 as described in conjunction with FIG. 13.

(Ink Supply System)

In accordance with the present invention, the ink supply system is such that the member for adsorbing eluted substance as described above is arranged in the position where it is in contact with ink which resides in the ink retaining container up to the discharge openings (ports).

The ink supply system of the present invention does not allow the eluted substance to adhere to the flow paths or the physical property of ink to change. Therefore, it is possible to use the system for the ink jet head which requires the highly precise shooting of smaller droplets, as well as for the ink jet recording apparatus that uses such head.

For example, the system can be used for an ink jet head whose discharge amount is 15 pl or less. The effect of the present invention is demonstrated sufficiently with the adoption of this ink supply system even for an ink jet head whose discharge amount is 10 pl or less. Particularly, the demonstration of effect is more conspicuous with the head whose discharge amount is 8.5 pl or less.

Also, with this ink supply system, the eluted substance is not allowed to adhere to the discharge pressure generating unit. Therefore, the effect of the present invention can be demonstrated sufficiently if this system is adopted for the ink jet head provided with the heat generating resistors, such as the electrothermal converting members, the discharge pressure generating unit of which creates bubbles by the application of thermal energy. This system is also applicable to the discharge pressure generating unit formed by piezoelectric devices.

Also, the ink supply system of the present invention suppresses the adhesion of eluted substance to the flow paths or the like. Therefore, it is made possible to perform high-frequency driving at 10 kHz or more, or at 20 kHz or more in particular.

Further, it is possible to use the ink supply system of the present invention for an ink jet head provided with recovery means. The recovery means is such that the eluted substance is removed by suction or ink is discharged provisionally. Here, with the application of the present invention, it becomes possible to make the suction intervals longer even if there is a need for the suction of eluted substance. As a result, there is an advantage that the receptacle for the waste ink thus sucked for recovery can be made smaller, among some others, and the apparatus can be made smaller accordingly. Also, even if the provisional discharges are needed, its frequency can be reduced.

(Ink Jet Recording Apparatus)

Particularly among the ink jet recording methods, the present invention demonstrates the excellent effect with respect to the recording head and recording apparatus of the so-called ink jet recording type which performs recording by forming flying droplets by the utilization of thermal energy.

As regards the typical structure and operational principle of such method, it is preferable for the present invention to adopt those which can be implemented using the fundamental principle disclosed in the specifications of U.S. Pat. Nos. 4,723,129 and 4,740,796, for example. This method is applicable to the so-called on-demand type recording and a continuous type recording as well. Particularly, in the case of the on-demand type, at least one driving signal is applied to electrothermal converting members, each disposed on a liquid (ink) retaining sheet or liquid path, in accordance with recording information in order to provide a rapid temperature rise so that film boiling beyond nuclear boiling is created on the thermoactive surface of the recording head. As a result, bubbles can be formed effectively in the liquid (ink) one to one by the driving signals thus applied. By the development and contraction of each bubble, the liquid (ink) is discharged through each discharge opening (port) to produce at least one droplet. The driving signal is more preferably in the form of pulses because the development and contraction of such bubble can be effectuated instantaneously and appropriately, and the liquid (ink) is discharged with quicker response.

The driving signal in the form of pulses is preferably such as disclosed in the specifications of U.S. Pat. Nos. 4,463,359 and 4,345,262. In this respect, the temperature increasing rate of the thermoactive surface is preferably such as disclosed in the specification of U.S. Pat. No. 4,313,124 for an excellent recording in a better condition.

As the structure of the recording head, there are included in the present invention, the structure such as disclosed in the specifications of U.S. Pat. Nos. 4,558,333 and 4,459,600 in which the thermal activation portions are arranged in a curved area, besides those which are shown in each of the above-mentioned specifications wherein the structure is arranged to combine the discharging openings, liquid paths, and the electrothermal converting members (linear type liquid paths or right-angled liquid paths).

In addition, the present invention is effectively applicable to the structure disclosed in Japanese Patent Laid-Open Application No. 59-123670 wherein a common slit is used as the discharging openings for plural electrothermal converting members, and to the structure disclosed in Japanese Patent Laid-Open Application No. 59-138461 wherein an aperture for absorbing pressure waves of thermal energy is formed corresponding to the discharge openings.

Further, as a recording head for which the present invention can be utilized effectively, there is the full-line type recording head whose length corresponds to the maximum width of a recording medium recordable by such recording apparatus. For the full-line type recording head, it may be possible to adopt either a structure whereby to satisfy the required length by combining a plurality of recording heads or a structure arranged by one recording head integrally formed.

In addition, the present invention is effectively applicable to an exchangeable recording head of a chip type that can be electrically connected with the apparatus main body, the ink supply therefor being made possible from the apparatus main body, when mounted on the apparatus main body or to the use of a cartridge type recording head provided integrally for the recording head itself.

Also, it is preferable to additionally provide a recording head with recovery means and preliminarily auxiliary means because these additional means will contribute to making the effectiveness of a recording apparatus more stabilized. To name them specifically, these are capping means, cleaning means, suction or compression means, preheating means such as electrothermal converting members or heating devices other than such converting members or the combination of those types of members and devices, and a predischarge means for performing discharge other than the regular discharge with respect to the recording head.

Also, as the recording modes of a recording apparatus, the present invention is not only applicable to a recording mode in which only one main color such as black is used for recording, but also, the invention is extremely effective in applying it to an apparatus having plural recording heads provided for use of at least one of multiple colors prepared by different colors or full-color prepared by mixing colors, irrespective of whether the recording heads are integrally structured or structured by a combination of plural recording heads.

In the embodiments of the present invention described above, while the ink has been described as liquid, it may be an ink material which is solidified below the room temperature but soften or liquefied at the room temperature or soften or liquefied within a temperature range of the temperature adjustment generally practiced for an ink jet recording, that is, not lower than 30° C. but not higher than 70° C. In other words, it should be good enough if only ink is liquefied at the time of giving recording signals for use.

In addition, while positively preventing the temperature rise due to thermal energy by the use of such energy as an energy to be consumed for changing states of ink from solid to liquid, or by the use of the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain ink in the form of liquid or solid in the recesses or through holes of a porous sheet such as disclosed in Japanese Patent Laid-Open Application No. 54-56847 or 60-71260 in order to enable the ink to face the electrothermal converting members. In the present invention, the most effective method for the various kinds of ink mentioned above is the one that enables the film boiling method to be effectuated as described above.

For the present invention, it is of course possible to combine two or more respective structures for use.

(Embodiment A)

Hereinafter, in accordance with the embodiment A, the present invention will be described further in detail.

(Ink Absorbent)

The following absorbents A to C are prepared as ink absorbent, and the ink container used is produced by injection molding with polypropylene (manufactured by Nippon Polichemi K.K.).

(Ink Absorbent A)

The absorbent A is the polyurethane formed in the manufacture processes having a step of thermal compression among them. One absorbent weighs 4 g approximately.

(Ink Absorbent B)

The absorbent B is the polyurethane formed in the manufacture processes having no step of thermal compression among them. One absorbent weighs 4 g approximately.

(Ink Absorbent C)

The absorbent C is the one formed by polypropylene fabric. One absorbent weights 4 g approximately.

(The Member for Adsorbing Eluted Substance)

As the adsorption member, there is used the one which is heat sealed after wrapping the following adsorbents with unwoven fabric (PO20C manufactured by Asahi Kasei K.K. with the melt blowing method):

(Adsorbent 1)

The methacrylate having the octadecyl group induced, SK-GEL ODP (granular diameter 45 to 90 $\mu$m) manufactured by Soken Kagaku K.K.

(Adsorbent 2)

The methacrylate having the octadecyl group induced, SK-GEL ODP (granular diameter 100 to 300 $\mu$m) manufactured by Soken Kagaku K.K.

(Adsorbent 3)

The methacrylate having the phenyl group induced, SK-GEL PH3 (granular diameter 74 to 150 $\mu$m) manufactured by Soken Kagaku K.K.

(Adsorbent 4)

The silica gel having the octadecyl group induced, SK-GEL ODP GEL (granular diameter 74 to 150 $\mu$m) manufactured by Soken Kagaku K.K.

(Adsorbent 5)

Methacrylate Diaion HP20MG (manufactured by Mitsubishi Chemicals K.K.)

(Adsorbent 6)

Styrene divinyl benzene Diaion HP20SS (manufactured by Mitsubishi Chemicals K.K.)

(Ink)

As ink retained in the ink retaining container, the ink having the following composition is used. The percentage given below indicates the weight % without any exception.

(Ink a)

| Ink a | |
|---|---|
| DBL 199 (Zeneca Corporation) | 3% |
| glycerine | 5% |
| thiodiglycol | 5% |
| isopropyl alcohol | 4% |
| pure water | 83% |

Ink a presents pH10 using 50% sodium hydroxide.

(Ink b)

The composition of ink b is the same as that of the ink a, but its pH is 7.5.

(Embodiments 1 to 12 and Comparison Examples 1 to 3)

For the embodiments 1 to 12 and the comparison examples 1 to 3, the materials shown in Table 1 is combined, and the member for adsorbing eluted substance is installed above the ink supply opening of the ink cartridge shown in FIG. 12. Ink is filled in an amount of approximately 30 g and sealed with a multilayered film of polypropylene. Then, the evaluation is made with the evaluation method which will be described later. The result of the evaluation is shown on the Table 1.

(Embodiment 13 and Comparison Example 4)

For the embodiment 13 and the comparison example 4, ink is filled in the ink cartridge provided with the pouch of multilayered polypropylene film conventionally in use by the application of the printing method whereby to supply ink to the head mounted on the carriage through the tube by the utilization of water head pressure. Then, the member for adsorbing eluted substance is installed on the sub-tank unit of the printer. By the evaluation method which will be described later, the evaluation is made with the results given in the Table 1.

(Evaluation Method)

The ink retaining container which has been manufactured anew is held in a thermostatic bath at 60° C. for two months. Then, the following evaluation is. conducted:

(Evaluation 1)

A syringe (without needle) is attached to the ink supply opening of the ink retaining containers of the embodiments and comparison examples to withdraw ink. Then the amount of eluted substance that has been eluted into ink is measured. Given the amount of the eluted substance in ink of the comparisons 1 to 4 as c, and also, the amount of the eluted substance in ink of the embodiments 1 to 13 as $c_0$, the removal rate is obtained by the formula, $(c-c_0)/c\times100$ with the case where the same absorbent is used or the case where no absorbent is used as the comparison targets. The evaluation standard is as follows:

A: The removal rate of the eluted substance is 90% or more.

B: The removal rate of the eluted substance is more than 70% but less than 90%.

C: The removal rate of the eluted substance is 70% or less.

(Evaluation 2)

Figure 15A:
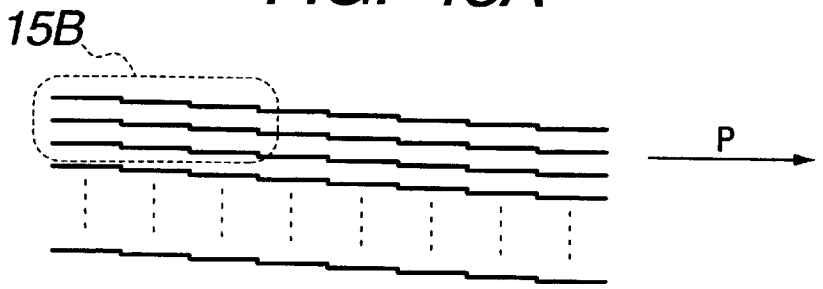
FIGS. 15A and 15B are views which illustrate the printed pattern used for the evaluation 2.
Figure 15B:
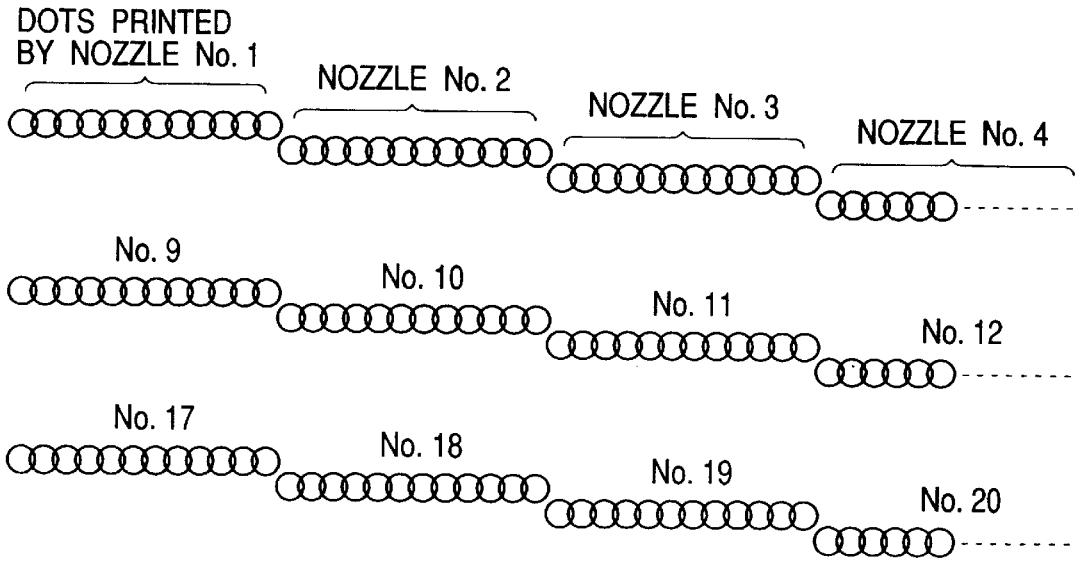

The solid pattern of 25% duty is printed in a quantity equivalent to five A3-sized sheets, and left intact for 10 minutes. Then, the checking pattern is printed in the form of dotted steps as shown in FIGS. 15A and 15B on the coated sheet (HR-101 manufactured by Canon K.K.) for special use.

In other words, discharge is made, at first, from one nozzle each at intervals of eight nozzles, such as No. 1 nozzle, No. 9 nozzle, No. 17 nozzle, and . . . in the printing direction (the main scanning direction). Then, after a certain number of dots have been discharged (in FIGS. 15A and 15B, 12 dots for the convenience' sake of description), the same dot numbers are discharged from each of the adjacent nozzles, such as No. 2 nozzle, No. 10 nozzle, No. 18 nozzle, and . . . . Next, from No. 3 nozzle, No. 11 nozzle, No. 19 nozzle, and . . . , and so on. This sequence is repeated eight times.

In this manner, a pattern is formed with fine lines at the same pitches. Then, if the impacted points of droplets are in the regular positions, an extremely unified half tone pattern is recognized by eye-sight. If the impacted points are deviated from the regular positions, unevenness or streaks are observed.

The prints thus made are evaluated by eye-sight in accordance with the following standard:

A: Prints are continuously maintained each in the normal dot diameter without any unevenness, streaks, or any others.

B: Slight disturbance is noticed, but the print level does not present any problem.

C: Unevenness and streaks are conspicuous.

D: Unevenness and streaks are conspicuous, and disabled discharges are noticed.

(Evaluation 3)

Under the same condition as the evaluation 2, the dot diameter measurement pattern and the solid pattern are printed on the non-coat sheet (NP-DK manufactured by Dai Showa Seishi K.K.) for use of electronic photography. The evaluation is made in accordance with the following standard:

A: Dot diameter and density are normal.

B: Spreading and variation are noticed on the dots.

C: Ink permeation to the back side of the sheet is noticed.

the ink absorbent or the like, is selectively adsorbed by the adsorption member. Therefore, it becomes possible to perform high quality recording without twisting, spreading, permeation to the back side of a recording sheet, or the like.

Also, in accordance with the present invention, it becomes possible to enhance the impact accuracy for a clearer and more precise printing at higher speeds even for the ink jet recording method whereby to record with ink droplets discharged from fine nozzles, because there is no possibility that the polyol or other eluted substance becomes transparent balls in the nozzles, which are deposited to impede the ink flow or to disturb the discharge direction of ink by being allowed to adhere to the circumference of discharge openings (ports).

Also, for the type that performs discharges by the application of heat among those ink jet methods, there is no possibility that the eluted substance adheres to the heating members, and that the performance thereof is caused to be lowered.

Also, there is no need for executing the frequent suction of the eluted substance periodically, hence making it possible to make the suction interval longer even if the suction is needed. As a result, it becomes possible to suppress the wasteful use of ink, and at the same time, to make the waste ink receptacle smaller, which is required for the reception of the eluted substance and ink thus sucked. Then, the ink jet recording apparatus can be made smaller accordingly.

Further, the process in which the absorbent is cleaned by use of alcoholic solution or the like is no longer needed or it is made lighter. Therefore, the waste liquid, such as a large amount of organic solution, does not flow out any longer. The costs of waste liquid disposition are saved. Also, in a long-term reservation, the decomposed substance is noticed anew due to the decomposition caused by components contained in ink, but it is possible to remove such decomposed substance completely.

Also, the adsorbent itself can be reused, which presents another advantage that its load is smaller in the environmental aspect.

Here, with the structure arranged as described above, it becomes clear that the eluted substance of the ink absorbent or the ink tank itself can be removed effectively.

TABLE 1

| Embodiment No. | Printing head Method | Physical resolution of nozzle | Kind of adsorbent | Kind of ink absorbent | Amount of adsorbent (g) | Ink | Evaluation 1 | Evaluation 2 | Evaluation 3 |
|---|---|---|---|---|---|---|---|---|---|
| 1 | Piezo method | 360 | 1 | A | 0.003 | a | B | A | A |
| 2 | Piezo method | 720 | 1 | A | 0.003 | a | B | B | A |
| 3 | Bubble jet method | 360 | 1 | A | 0.003 | a | B | A | A |
| 4 | Bubble jet method | 600 | 1 | A | 0.003 | a | B | B | A |
| 5 | Bubble jet method | 600 | 1 | A | 0.3 | a | A | A | A |
| 6 | Bubble jet method | 600 | 1 | B | 0.003 | a | B | A | A |
| 7 | Bubble jet method | 1200 | 1 | A | 0.003 | a | B | B | A |
| 8 | Bubble jet method | 1200 | 2 | A | 0.1 | a | A | A | A |
| 9 | Bubble jet method | 1200 | 3 | A | 0.1 | a | A | B | A |
| 10 | Bubble jet method | 1200 | 4 | A | 0.1 | b | A | A | A |
| 11 | Bubble jet method | 1200 | 5 | A | 0.1 | a | A | A | A |
| 12 | Bubble jet method | 1200 | 6 | C | 0.1 | a | A | A | A |
| 13 | Bubble jet method | 1200 | 1 | None | 0.1 | a | A | A | A |
| Comparison Ex. 1 | Bubble jet method | 1200 | None | A | None | a | C | D | C |
| Comparison Ex. 2 | Bubble jet method | 1200 | None | B | None | a | C | C | B |
| Comparison Ex. 3 | Bubble jet method | 1200 | None | C | None | a | C | C | A |
| Comparison Ex. 4 | Bubble jet method | 1200 | None | None | None | a | C | C | A |

The discharge amount of each head of the above embodiments is changed variously, but no problem is encountered even at 20 pl or less.

In accordance with the present invention, the polyol, plastic agent, active agent, catalyzer, lubricant, neutralizer, or some other hydrophobic substance, which is eluted from However, it is founded as a result of a series of experiments and studies that if the ink that has been used contains the interfacial active agent for the adjustment of the surface tension, the interfacial active agent thus contained in ink is partly taken in at the initial stage of the contact between ink and adsorbent, and then, the surface tension of ink is caused to rise temporarily immediately after the recording has started.

With the rise of the surface tension of ink, the fixation capability of ink is deteriorated. In a case of color recording, then, the mixture of ink tends to present spreading eventually. Also, the wettability in the ink flow paths is lowered. As a result, ink shortage may easily take place when ink is discharged.

Now, hereunder, the description will be made of the results of the studies made by the inventors hereof in order to improve the problems related to the adsorption of the interfacial active agent contained in ink when the adsorbent and the active agent are in contact initially as described above.

To achieve this objective, the inventors hereof have found that the adsorption treatment should only be carried out with the interfacial active agent or the like with respect to the adsorbent by the use of which the fundamental objectives can be attained as described earlier. In this respect, the adsorption treatment referred to in the specification hereof is to make the capability of the adsorbent more selective by adding a specific substance in advance to the adsorbent which is described in conjunction with the embodiment A for the attainment of the fundamental objectives of the present invention.

Here, the adsorption treatment agent has been studied in order to carry out the excellent adsorption treatment so that as the characteristics of the adsorbent thus obtained, the adsorbent does not adsorb any interfacial active agent contained in ink, but the hydrophobic substance that may exert influences on the ink supply performance, printing, and others. As a result, it has been found that the interfacial active agent should preferably be used as given below for the purpose.

In other words, it is preferable to use the interfacial active agent that may reduce the surface tension greatly (having a higher wettability). It is particularly preferable to use the interfacial active agent whose surface tension is 40 dyne/cm or less in the 0.5% water solution or more preferably, 35 dyne/cm or less. Also, if the hydrophobic portion is too much in the interfacial active agent, the performance of the adsorption becomes inferior with respect to the polyol or other hydrophobic substance. Therefore, for the adsorption treatment, it is preferable to use the interfacial active agent whose HLB (hydrophilic-lipophilic balance) is at least 8 or more, or more preferably, 10 or more, so that the agent is easily compatible with water.

More specifically, the adoptable interfacial active agent is as follows, among some others:

Acetylene glycol derivative, denatured silicon derivative, polyoxy ethylene castor oil ether, polyethylene rosin ether, higher alcohol EO/PO additive, EOPOEO additive, polyethylene glycol, bisphenol polyethylene glycol, long chain alkylamine EO additive, polyoxy ethylene alkylether, polycarboxylate derivative, polystyrene sulfonate, polyoxy ethylene aminoether derivative, polyoxy ethylene polyoxy propylene alkylether, polyoxy ethylene polyoxy propylene ether, armonic nonyl phenol, aliphatic tridecyl alcohol, aliphatic lauric alcohol, polyoxy ethylene (aliphatic) alkylether phosphate soda, polyoxy ethylene (aliphatic) alkylether phosphate ammonium salt, polyoxy ethylene (aliphatic)alkylether potassium phosphate, polyoxy ethylene (aliphatic)alkylether phosphate amine, polyoxy ethylene (aliphatic)alkylether phosphate soda, polyoxy ethylene (aliphatic)alkylether phosphate ammonium salt, polyoxy ethylene (aliphatic)alkylether phosphate monoethanol amine, polyoxy ethylene (aliphatic)alxylether phosphate diethanol amine, polyoxy ethylene (aliphatic)alkylether phosphate triethanol amine.

As the hydrophilic treatment method, it may be possible to dry the adsorbent by use of the thermostatic bath after it has been dipped into the interfacial active agent solution as described above. As the mode of dipping, it may be possible to fill the adsorbent and the above-mentioned interfacial active agent in the beaker or evaporating dish, and then, agitate them by use of the ultrasonic cleaner, stirrer, or the like or it may be possible to fill them into a column or the like and flow the preprocessing agent in it.

Here, the description will be described of the aspect where the interfacial active agent is not adsorbed by means of the treatment of the adsorbent with the above-mentioned interfacial active agent.

In general, the polyol used for the polyurethane adopted as the ink absorbent contains a number of hydrophobic groups in one molecular. Conceivably, the larger the molecular amount, the stronger is the hydrophobic property. Conceivably, for example, the adsorbent functions to adsorb the hydrophobic group (chemical adsorption) to the octadecyl group (hydro-phobic group) in the polymer, and to perform the physical adsorption where molecule enters the netting structure of the polymer.

The polyol has a larger amount of molecule so as to be easily adsorbed physically, and also, easily adsorbed chemically, because it contains a large amount of hydrophobic group. In contrast, the interfacial active agent has a smaller amount of molecule and the hydrophobic group. As a result, this agent is not easily adsorbed physically nor chemically as compared with the polyol.

(Embodiment B)

Now, hereunder, the present invention will be described further in detail using the embodiment B.

(Ink Absorbent)

The following absorbents A to C are prepared as the ink absorbent, and the ink container is prepared by the injection molding using polypropylene (manufactured by Nippon PoliChemi K.K.). The absorbents A to C are the same as those used for the embodiment A.

(Ink Absorbent A)

The absorbent A is the polyurethane processed in the thermal compression step in the manufacture process, and weighs approximately 4 g per absorbent.

(Ink Absorbent B)

The absorbent B is the polyurethane which is not processed in the thermal compression step in the manufacture process, and weighs approximately 4 g per absorbent.

(Ink Absorbent C)

The absorbent C is an absorbent formed by polypropylene fabric, and weighs approximately 4 g per absorbent.

(Preprocessing Agent)

As the preprocessing agent of the absorbent, the following water soluble interfacial active agent is used. As the preprocessing method, each of the following adsorbents is provided as each sample by being dipped into each 10% water solution of the interfacial active agents, and then, dried after a ten-minute ultrasonic treatment using the ultrasonic cleaning device:

| | |
|---|---|
| (Preprocessing agent a) | Acetylenol EH (manufactured by Kawaken Fine Chemicals K.K.) |
| (Preprocessing agent b) | Polyoxy ethylene aminoether |
| (Preprocessing agent c) | Denatured silicon derivative |
| (Preprocessing agent d) | Acetylene glycol interfacial active agent Surphnol 465 (manufactured by Nippon Yushi K.K.) |
| (Preprocessing agent e) | Polyoxy ethylene/propylene alkylether PBC-33 (manufactured by Nikko Chemical K.K.) |
| (Preprocessing agent f) | Polyoxy ethylene alkylether BL-4.2 (manufactured by Nikko chemical K.K.) |
| (Preprocessing agent g) | Polyoxy ethylene alkyl phosphate soda Monoethanol amine of the Phosphonol RS-960 (manufactured by Tohou Chemical K.K.) |

| | HLB | Surface tension (0.5% water solution) |
|---|---|---|
| (Preprocessing agent a) | 14 | 33 dyne / cm |
| (Preprocessing agent b) | 14 | 40 |
| (Preprocessing agent c) | 8 | 26 |
| (Preprocessing agent d) | 13 | 33 |
| (Preprocessing agent e) | 13 | 32 |
| (Preprocessing agent f) | 12 | 26 |
| (Preprocessing agent g) | 12 | 33 |

(Member for Adsorbing Eluted Substance)

As the adsorption member, the following adsorbent is wrapped with the unwoven fabric (Melt blow, PO20C manufactured by Asahi Kasei K.K.) and heat sealed. The following absorbents are given the preprocessing described above:

| | |
|---|---|
| (Adsorbent 7) | Methacrylate having octadecyl group induced thereto, Sk-GEL ODP gel (granular diameter 100 to 300 μm) manufactured by Soken Kagaku K.K. |
| (Adsorbent 8) | Methacrylate having phonal group induced thereto, SK-GEL PH3 gel (granular diameter 74 to 150 μm) manufactured by Soken Kagaku K.K. |
| (Adsorbent 9) | Silica gel having octadecyl group induced thereto, SL-GEL ODS gel (granular diameter 74 to 150 μm manufactured by Soken Kagaku K.K. |
| (Adsorbent 10) | Methacrylate, Diaion HP20MG manufactured by Mitsubishi Chemicals K.K. |
| (Adsorbent 11) | Styrene divinyl benzene, Diaion HP20SS manufactured by Mitsubishi Chemicals K.K. |

(Ink)

As ink retained in the ink retaining container, the ink having the following composition is used; here, the percentages indicated below are all weight %:

(Ink c)

| (Ink c) | |
|---|---|
| DBL 199 (manufactured by Senega) | 3% |
| Glycerin | 5% |
| Thiodi glycol | 5% |
| Isopropyl alcohol | 4% |
| Acethylenol EH | 0.4% |
| Pure water | 82.6% |

-continued

| (Ink d) | |
|---|---|
| DBL 199 (manufactured by Senega) | 3% |
| Glycerin | 5% |
| Thiodi glycol | 5% |
| Isopropyl alcohol | 4% |
| Acethylenol EH | 0.4% |
| Pure water | 82.6% |

50% Sodium hydroxide is added to make the pH of the ink a 10, and the pH of the ink b is 7.5.

(Embodiments 14 to 25 and Comparison Examples 5 and 6)

For the embodiments 14 to 25, and the comparison examples 5 and 6, the materials listed on the Table 1 are combined to arrange the member for adsorbing eluted substance above the ink supply opening of the ink cartridge shown in FIG. 12. Ink is filled in an amount of approximately 30 g, and sealed with the multilayered polypropylene film. The evaluation is made by the evaluation method which will be described later. The results are shown on the Table 2.

(Embodiment 26 and Comparison Example 7)

For the embodiment 26 and the comparison example 7, the adopted printing method is of the type where ink is supplied to the head on the carriage through the tube by the utilization of water head pressure, and ink is filled in the ink cartridge with the multilayered polypropylene film formed in the pouch which is conventionally in use. Then, the member for adsorbing eluted substance is arranged in the sub-tank of the printer. The evaluation is made by the evaluation method which will be described later. The results are shown on the Table 2.

(Evaluation Method)

The ink retaining container which has been manufactured anew is held in a thermostatic bath at 60° C. for two months. Then, the following evaluation is conducted:

(Evaluation 0)

A syringe (without needle) is attached to the ink supply opening of the ink retaining containers of the embodiments and comparison examples to withdraw ink. Then, the amount of the interfacial active agent in ink is measured.

A: The density of the interfacial active agent is 95% or more of the initial ink value.

B: The density of the interfacial active agent is 80% or more of the initial ink value.

C: The density of the interfacial active agent is less than 80% of the initial ink value.

(Evaluation 1) The Same as the Embodiment A.

A syringe (without needle) is attached to the ink supply opening of the ink retaining containers of the embodiments and comparison examples to withdraw ink. Then, the amount of the substance eluted into ink is measured. Given the eluted substance ink of the comparison examples 1 to 4 as c, and the amount of the substance eluted into ink of the embodiments 14 to 26 as $c_0$. With the case where the same absorbents are used as the comparison object, the removal rate is obtained by the formula of $\{(c-c_0)/c\}\times 100$. The evaluation standard is as follows:

A: The removal rate of the eluted substance is 90% or more.

B: The removal rate of the eluted substance is 70% or more but 90% or less.

C: The removal rate of the eluted substance is 70% or less.

(Evaluation 2) The Same the Embodiment A

The solid pattern of 25% duty is printed in a quantity equivalent to five A3-sized sheets, and left intact for 10 minutes. Then, the checking pattern is printed in the form of dotted steps as shown in FIGS. 15A and 15B on the coated sheet (HR-101 manufactured by Canon K.K.) for special use.

In other words, discharge is made, at first, from one nozzle each at intervals of eight nozzles, such as No. 1 nozzle, No. 9 nozzle, No. 17 nozzle, and . . . in the printing direction (the main scanning direction). Then, after a certain number of dots have been discharged (in FIGS. 15A and 15B, 12 dots for the convenience' sake of description), the same dot numbers are discharged from each of the adjacent nozzles, such as No. 2 nozzle, No. 10 nozzle, No. 18 nozzle, and . . . . This sequence is repeated eight times.

In this manner, a pattern is formed with fine lines at the same pitches. Then, if the impacted points of droplets are in the regular positions, an extremely unified half tone pattern is recognized by eye-sight. If the impacted points are deviated from the regular positions, unevenness or streaks are observed.

The prints thus made are evaluated by eye-sight in accordance with the following standard:

A: Prints are continuously maintained each in the normal dot diameter without any unevenness, streaks, or any others.

B: Slight disturbance is noticed, but the print level does not present any problem.

C: Unevenness and streaks are conspicuous, and disabled discharges are noticed.

(Evaluation 3)

Under the same condition as the evaluation 2, the dot diameter measurement pattern and the solid pattern are printed on the non-coat sheet (NP-DK manufactured by Dai Showa Seishi K.K.) for use of electronic photography. The evaluation is made in accordance with the following standard:

A: Dot diameter and density are normal.

B: Spreading and variation are noticed on the dots.

C: Ink permeation to the back side of the sheet is noticed.

In accordance with the present invention, the polyol, plastic agent, active agent, catalyzer, lubricant, neutralizer, or some other hydrophobic substance, which is eluted from the ink absorbent or the like, is selectively adsorbed by the adsorption member. Therefore, it becomes possible to perform high quality recording without twisting, spreading, permeation to the back side of a recording sheet, or the like. Further, even if ink containing interfacial active agent is used, there is almost no adsorption of the interfacial active agent. Therefore, the surface tension of ink is not allowed to rise significantly.

Also, in accordance with the present invention, it becomes possible to enhance the impact accuracy for a clearer and more precise printing at higher speeds even for the ink jet recording method whereby to record with ink droplets discharged from fine nozzles, because there is no possibility that the polyol or other eluted substance becomes transparent balls in the nozzles, which are deposited to impede the ink flow or to disturb the discharge direction of ink by being allowed to adhere to the circumference of discharge openings (ports).

Also, for the type that performs discharges by the application of heat among those ink jet methods, there is no possibility that the eluted substance adheres to the heating members, and that the performance thereof is caused to be lowered.

Also, there is no need for executing the frequent suction of the eluted substance periodically, hence making it possible to make the suction interval longer even if the suction is needed. As a result, it becomes possible to suppress the wasteful use of ink, and at the same time, to make the waste ink receptacle smaller, which is needed to receive the eluted substance and ink thus sucked. Then, the ink jet recording apparatus can be made smaller accordingly.

Further, there is no need for the step of cleaning the absorbent with alcoholic solution or the like or this processing step can be made lighter. As a result, there is not a large amount of wasted liquid of organic agent to be treated. The costs of waste liquid treatment can be curtailed here.

Also, the adsorbent itself can be reused, which presents another advantage that its load is smaller in the environmental aspect.

TABLE 2

| Embodiment No. | Printing head Method | Physical resolution of nozzle | Kind of adsorbent | Kind of pre-processing | Kind of ink absorbent | Amount of adsorbent (g) | Ink | Evaluation 0 | Evaluation 1 | Evaluation 2 | Evaluation 3 |
|---|---|---|---|---|---|---|---|---|---|---|---|
| 14 | Piezo method | 360 | 1 | a | A | 0.003 | a | A | B | A | A |
| 15 | Piezo method | 720 | 1 | b | A | 0.003 | a | B | B | B | A |
| 16 | Bubble jet method | 360 | 1 | c | A | 0.003 | a | B | B | A | A |
| 17 | Bubble jet method | 600 | 1 | d | A | 0.003 | a | A | B | B | A |
| 18 | Bubble jet method | 600 | 1 | e | A | 0.3 | a | A | A | A | A |
| 19 | Bubble jet method | 600 | 1 | f | B | 0.003 | a | A | B | A | A |
| 20 | Bubble jet method | 1200 | 1 | g | A | 0.003 | a | A | B | B | A |
| 21 | Bubble jet method | 1200 | 2 | a | A | 0.1 | a | A | A | A | A |
| 22 | Bubble jet method | 1200 | 3 | a | A | 0.1 | a | A | A | B | A |
| 23 | Bubble jet method | 1200 | 4 | a | A | 0.1 | b | A | A | A | A |
| 24 | Bubble jet method | 1200 | 5 | a | A | 0.1 | a | A | A | A | A |
| 25 | Bubble jet method | 1200 | 6 | a | C | 0.1 | a | A | A | A | A |
| 26 | Bubble jet method | 1200 | 1 | a | None | 0.1 | a | A | A | A | A |
| Comparison Ex. 5 | Bubble jet method | 600 | 1 | None | A | 0.3 | a | C | A | A | A |
| Comparison Ex. 6 | Bubble jet method | 1200 | 2 | None | A | 0.1 | a | C | A | A | A |
| Comparison Ex. 7 | Bubble jet method | 1200 | None | None | None | 0 | a | A | C | C | A |

Here, as to the aspect where the recording characteristics of ink are made lower in the initial stage of its use, the treatment agent which is processed by use of the interfacial active agent as in the embodiment B is applied with the structures shown in FIG. 1 to FIG. 10. Besides, the following structure can be named as the one capable of suppressing the influences exerted by the adsorption of the interfacial active agent in ink in the initial stage of its use with the adoption of the adsorbent as in the embodiment A:

For example, as described earlier, the interfacial active agent tends to be trapped by the adsorbent in the initial stage when the use of the ink tank begins. As the method that utilizes this tendency, the adsorbent shown in conjunction with the embodiment A is used, for example. Then, the compulsory recovery is executed by the recovery device arranged for the recording apparatus in the initial stage when the use of the ink tank begins.

In this manner, the very small amount of ink (1 to 2 cc, for instance), which is not used for recording but exhausted by means of the compulsory recovery, passes the adsorbent. Then, the adsorption capability is saturated with respect to the interfacial active agent in ink. As a result, when the ink used for recording passes the adsorbent, the interfacial active agent in ink is no longer adsorbed by the adsorbent. The ink is supplied to the head without such adsorption, thus making it possible to prevent the quality of recorded prints from being degraded. Also, it is possible to cope with this situation by devising the ink that should be filled in the ink tank.

Here, it is a desirable method whereby to arrange the density distribution of the interfacial active agent in ink so that the density of the interfacial active agent may be made higher on the ink supply opening side.

In other words, the density distribution of the interfacial active agent is modified in anticipation of the amount of the interfacial active agent that should be adsorbed by the treatment agent in the initial stage of ink use. For example, when the ink is continuously refilled, the density of the interfacial active agent may be adjusted. Also, for example, it may be possible to deal with the situation by filling in the ink having different density of contained interfacial active agent separately in two stages. By the adoption of a counter measure of the kind, it is possible to attain printing in good condition from the very beginning even if the adsorbent of the embodiment A is adopted for use here. Also, then, there is no need for the execution of the compulsory recovery, hence making it possible to save the wasteful consumption of ink.

In this respect, the structure whereby to adjust the density of the interfacial active agent may be formed by the application of the treatment agent disclosed in the embodiment B.

Now, therefore, it becomes possible to adopt the mode in which the adsorbent is used when manufacturing the ink absorbent, although in this specification various examples are described as to the mode in which the adsorbent is used with respect to the ink supply.

For example, in the process of the ink absorbent manufacture where water rinsing is performed, it is preferable to remove polyol by use of the adsorbent. Here, if polyol should be removed by rinsing, it is preferable to wring the rinsing water from the absorbent in the state of being compressed to the same extent as it is retained in the ink tank.

What is claimed is:

1. An ink retaining container comprising:

an ink retaining portion for retaining ink having a hydrophobic substance and a colorant;

an ink supply opening including an ink supply portion from said ink retaining portion, said ink supply opening for supplying ink to an ink jet head; and an atmospheric communication opening for communicating said ink retaining portion with the air outside, said ink retaining container being provided with an adsorption member arranged in a position to be in contact with ink in said ink retaining container, said adsorption member having a higher adsorption capability with respect to the hydrophobic substance than the colorant.

2. An ink retaining container according to claim 1, wherein said ink retaining container retains the ink directly.

3. An ink retaining container according to claim 2, wherein said ink retaining container directly retaining ink therein is a pouch or a rigid container having an ink contact surface formed by resin.

4. An ink retaining container according to claim 3, wherein said adsorption member is arranged at an inner wall face of said pouch or container.

5. An ink retaining container according to claim 3, wherein said adsorption member is arranged to cover an ink supply opening of said pouch or container.

6. An ink retaining container according to claim 3, wherein said adsorption member is dispersable in the ink retained in said pouch or container.

7. An ink retaining container according to claim 1, wherein said ink retaining container retains the ink in an ink absorbent incorporated therein.

8. An ink retaining container according to claim 7, wherein said ink retaining container is provided with the ink absorbent almost on an entirety of the interior thereof.

9. An ink retaining container according to claim 7, wherein said ink retaining container comprises a first chamber having the ink absorbent retained therein, and a second chamber retaining ink directly, said first and second chambers being communicated through a communicating portion, and said first chamber being provided with said ink supply opening and said atmospheric communication opening.

10. An ink retaining container according to claim 7, wherein said ink absorbent is selected from among a compressively retainable porous member, a porous member formed by thermal compression, a fabric aggregate, and a fabric aggregate formed by thermal compression.

11. An ink retaining container according to claim 7, wherein said adsorption member is dispersable in the ink absorbent.

12. An ink retaining container according to claim 7, wherein said adsorption member is arranged to be between the ink absorbent and a main body of the ink retaining container.

13. An ink retaining container according to claim 7, wherein said adsorption member is arranged to be between the ink absorbent and the ink supply opening.

14. An ink retaining container according to claim 1, wherein said adsorption member is a silica gel having a hydrophobic group inducted onto the a surface thereof or a polymer having a hydrophobic group induced onto said chain thereof.

15. An ink retaining container according to claim 14, wherein an adsorption treatment is given to said adsorbent.

16. An ink retaining container according to claim 15, wherein said adsorption treatment is executed by use of an interfacial active agent.

17. An ink retaining container according to claim 16, wherein said interfacial active agent is HLB 8 or more.

18. An ink retaining container according to claim 16, wherein a surface tension of said interfacial active agent is 40 dyne/cm or less at the time of being prepared as 0.5% water solution.

19. An ink retaining container according to claim 14, wherein said hydrophobic group is at least one kind selected from among a long chain alkyl group, an allyl group, a trialkylsilyl group, and an cyanoalkyl group.

20. An ink retaining container according to claim 14, wherein said hydrophobic group is a long chain alkyl group having carbon numbers of 8 to 18 or a phenyl group.

21. An ink retaining container according to claim 14, wherein said hydrophobic group is an octadecyl group or a phenyl group.

22. An ink retaining container according to claim 14, wherein said polymer is a crosslinked poly (metha) acrylic acid ester resin, or a crosslinked polystyrene resin.

23. An ink retaining container according to claim 22, wherein said crosslinked resin is porously granular.

24. An ink retaining container according to claim 1, wherein said ink retaining container retains ink therein, and an interfacial active agent in ink residing in the vicinity of the ink supply opening is higher in density than that in ink residing in another area thereof.

25. An ink supply system comprising:

an ink jet head;

an ink retaining container provided with an ink retaining portion to retain ink having a hydrophobic substance and a colorant, an ink supply opening including an ink supply portion from said ink retaining portion for supplying the ink to said ink jet head, and an atmospheric communication opening to communicate said ink retaining portion with the air outside;

ink supply paths communicating said ink jet head with said ink retaining container; and an adsorption member being arranged in a position to be in contact with ink in any of said ink jet head, said ink retaining container, or said ink supply paths, said adsorption member having a higher capability of adsorption with respect to the hydrophobic substance than the colorant.

26. An ink supply system according to claim 25, wherein said ink jet head and said ink retaining container are connected by a tubular ink supply path, and said adsorption member is arranged either for the ink induction portion of said tubular ink supply path, on an inner surface of the tubular ink supply path, or in the structural material of the tubular ink supply path.

27. An ink supply-system according to claim 26, wherein said ink jet head discharges ink in droplets of 10 pl or less.

28. An ink supply system according to claim 25, wherein said ink jet head discharges ink in droplets of 15 pl or less.

29. An ink supply system according to claim 28, wherein said ink jet head discharges ink in droplets of 8.5 pl or less.

30. An ink supply system according to claim 25, wherein said ink jet head discharges ink by creating bubbles through utilization of thermal energy.

31. An ink supply system according to claim 30, wherein said ink jet head is driven at a high frequency of 10 kHz or more.

32. An ink supply system according to claim 31, wherein said ink jet head is driven at a high frequency of 20 kHz or more.

33. An ink jet recording apparatus having the ink supply system according to claim 25 mounted thereon, said recording apparatus further having a recovery mechanism for exhausting ink from said ink supply system at a specific timing to maintain and recover an ink discharge condition from said ink jet head, and executing an initial recovery by exhausting ink in an extremely minute quantity at least when the ink retaining container of said ink supply system is replaced.

* * * * *

UNITED STATES PATENT AND TRADEMARK OFFICE

CERTIFICATE OF CORRECTION

PATENT NO. : 6,302,533 B1
DATED : October 16, 2001
INVENTOR(S) : Masako Shimomura et al.

It is certified that error appears in the above-identified patent and that said Letters Patent is hereby corrected as shown below:

Title page,
Item [57], ABSTRACT,
Line 15, "form" should read -- from --.

Column 1,
Line 26, "performs" should read -- perform --; and
Line 27, "perform" should read -- performs --.

Column 3,
Line 26, "the" should read -- this --;
Line 33, "the" should read -- this --; and
Line 39, "case." should read -- cases. --.

Column 4,
Line 12, "the" should read -- this --;
Line 17, "the" should read -- these --;
Line 21, "to" should read -- of --; and
Line 34, "again," should read -- agent --.

Column 6,
Line 61, "group inducted" should read -- groups induced --; and
Line 62, "group inducted" should read -- groups induced --.

Column 7,
Line 19, "compound which is" should read -- compounds which are --; and
Line 24, "compound, which is" should read -- compounds which are --.

Column 8,
Line 26, "inducted" should read -- induced --.

UNITED STATES PATENT AND TRADEMARK OFFICE

CERTIFICATE OF CORRECTION

PATENT NO. : 6,302,533 B1
DATED : October 16, 2001
INVENTOR(S) : Masako Shimomura et al.

It is certified that error appears in the above-identified patent and that said Letters Patent is hereby corrected as shown below:

Column 10,
Line 25, "is" should read -- is a --; and
Line 66, "the kind," should read -- this kind, --.

Column 11,
Line 3, "10,. the" should read -- 10, the --;
Line 30, close up left margin;
Line 31, close up right margin;
Line 36, "an" should read -- a --; and
Line 48, "mounted" should read -- be mounted --.

Column 14,
Line 10, "of" should read -- of the --.

Column 15,
Line 64, "preferably" should read -- preferable --;
Line 67, "with" should read -- with a --.

Column 18,
Line 11, "Ink a" should be deleted;
Line 24, "is" should read -- are --; and
Line 46, "is." should read -- is --.

Column 21,
Line 55, "EOPOEO" should read -- EO PO EO --.

Column 24,
Line 65, "Same" should read -- Same as --.

UNITED STATES PATENT AND TRADEMARK OFFICE

CERTIFICATE OF CORRECTION

PATENT NO. : 6,302,533 B1
DATED : October 16, 2001
INVENTOR(S) : Masako Shimomura et al.

It is certified that error appears in the above-identified patent and that said Letters Patent is hereby corrected as shown below:

Column 28,
Line 44, "inducted" should read -- induced --; and "the a" should read -- a --; and
Line 63, "an" should read -- a --.

Column 30,
Line 5, "supply-system" should read -- supply system --.

Signed and Sealed this

Twelfth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,302,533 B1
DATED : October 16, 2001
INVENTOR(S) : Masako Shimomura et al.

It is certified that error appears in the above-identified patent and that said Letters Patent is hereby corrected as shown below:

Column 6,
Line 67, change “allyl” to -- aryl --.

Column 7,
Line 3, change “allyl” to -- aryl --.

Column 28,
Line 60, change “allyl” to -- aryl --

Signed and Sealed this

Seventh Day of January, 2003

JAMES E. ROGAN
*Director of the United States Patent and Trademark Office*